US009185783B2

(12) United States Patent
Holland et al.

(10) Patent No.: US 9,185,783 B2
(45) Date of Patent: Nov. 10, 2015

(54) WIRELESS PAIRING SYSTEM AND ASSOCIATED METHODS

(75) Inventors: Eric Holland, Indian Harbour Beach, FL (US); Eric Thosteson, Satellite Beach, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 790 days.

(21) Appl. No.: 13/463,020

(22) Filed: May 3, 2012

(65) Prior Publication Data

US 2012/0286672 A1 Nov. 15, 2012

Related U.S. Application Data

(60) Provisional application No. 61/486,315, filed on May 15, 2011, provisional application No. 61/486,322, filed on May 15, 2011.

(51) Int. Cl.
*H05B 37/02* (2006.01)

(52) U.S. Cl.
CPC ..... *H05B 37/0272* (2013.01)

(58) Field of Classification Search
CPC ..... H05B 37/0272
See application file for complete search history.

(56) References Cited

U.S. PATENT DOCUMENTS

| | | | | |
|---|---|---|---|---|
| 4,551,654 | A | | 11/1985 | Barnum et al. |
| 4,942,384 | A | | 7/1990 | Yamauchi et al. |
| 5,319,301 | A | | 6/1994 | Callahan et al. |
| 5,523,878 | A | | 6/1996 | Wallace et al. |
| 5,563,422 | A | | 10/1996 | Nakamura et al. |
| 5,726,435 | A | * | 3/1998 | Hara et al. ..... 235/494 |
| 5,747,976 | A | | 5/1998 | Wong et al. |
| 5,936,599 | A | | 8/1999 | Reymond et al. |
| 5,997,150 | A | | 12/1999 | Anderson |
| 6,140,646 | A | | 10/2000 | Busta et al. |
| 6,272,154 | B1 | | 8/2001 | Bala et al. |
| 6,341,876 | B1 | | 1/2002 | Moss et al. |
| 6,356,700 | B1 | | 3/2002 | Strobl |
| 6,561,656 | B1 | | 5/2003 | Kojima et al. |
| 6,594,090 | B2 | | 7/2003 | Kruschwitz et al. |
| 6,733,135 | B2 | | 5/2004 | Dho |
| 6,767,111 | B1 | | 7/2004 | Lai |
| 6,817,735 | B2 | | 11/2004 | Shimizu et al. |
| 6,853,150 | B2 | | 2/2005 | Clauberg et al. |

(Continued)

FOREIGN PATENT DOCUMENTS

| | | |
|---|---|---|
| WO | WO 2010/027459 | 3/2010 |
| WO | WO 2010/098811 | 9/2010 |
| WO | WO 2011/008251 | 1/2011 |
| WO | WO 2011/016860 | 2/2011 |

OTHER PUBLICATIONS

U.S. Appl. No. 13/464,292, filed May 4, 2012, Holland et al.

(Continued)

*Primary Examiner* — Thomas J Hiltunen
(74) *Attorney, Agent, or Firm* — Mark Malek; Daniel Pierron; Widerman Malek, PL

(57) ABSTRACT

A wireless pairing system and method are presented, the system having a network and a luminaire, which may include an electrical base, an enclosure, and a heat sink, as well as a light source, a network interface, a camera, and a controller in communication with the electrical base. The light source, the network interface, and the camera may be in communication with the controller, the controller having a central processing unit (CPU), and an input/output (I/O) interface. The controller, the camera, the light source and the network interface may be carried by the enclosure. The camera may capture an image having a configuration code associated with the network and the CPU may analyze the image to determine the existence of the configuration code. The CPU may then configure the network interface to connect the luminaire to the network so that the luminaire may be operated or monitored through the network.

48 Claims, 18 Drawing Sheets

(56) References Cited

U.S. PATENT DOCUMENTS

| | | | |
|---|---|---|---|
| 6,870,523 | B1 | 3/2005 | Ben-David et al. |
| 6,871,982 | B2 | 3/2005 | Holman et al. |
| 6,876,007 | B2 | 4/2005 | Yamakazi et al. |
| 6,967,761 | B2 | 11/2005 | Starkweather et al. |
| 6,974,713 | B2 | 12/2005 | Patel et al. |
| 7,042,623 | B1 | 5/2006 | Huibers et al. |
| 7,066,628 | B2 | 6/2006 | Allen |
| 7,070,281 | B2 | 7/2006 | Kato |
| 7,072,096 | B2 | 7/2006 | Holman et al. |
| 7,075,707 | B1 | 7/2006 | Rapaport et al. |
| 7,083,304 | B2 | 8/2006 | Rhoads |
| 7,138,770 | B2 | 11/2006 | Uang et al. |
| 7,178,941 | B2 | 2/2007 | Roberge et al. |
| 7,184,201 | B2 | 2/2007 | Duncan |
| 7,246,923 | B2 | 7/2007 | Conner |
| 7,255,469 | B2 | 8/2007 | Wheatley et al. |
| 7,261,453 | B2 | 8/2007 | Morejon et al. |
| 7,289,090 | B2 | 10/2007 | Morgan |
| 7,300,177 | B2 | 11/2007 | Conner |
| 7,303,291 | B2 | 12/2007 | Ikeda et al. |
| 7,325,956 | B2 | 2/2008 | Morejon et al. |
| 7,342,658 | B2 | 3/2008 | Kowarz et al. |
| 7,344,279 | B2 | 3/2008 | Mueller et al. |
| 7,349,095 | B2 | 3/2008 | Kurosaki |
| 7,400,439 | B2 | 7/2008 | Holman |
| 7,427,146 | B2 | 9/2008 | Conner |
| 7,429,983 | B2 | 9/2008 | Islam |
| 7,434,946 | B2 | 10/2008 | Huibers |
| 7,438,443 | B2 | 10/2008 | Tatsuno et al. |
| 7,476,016 | B2 | 1/2009 | Kurihara |
| 7,489,086 | B2 | 2/2009 | Miskin et al. |
| 7,520,642 | B2 | 4/2009 | Holman et al. |
| 7,530,708 | B2 | 5/2009 | Park |
| 7,537,347 | B2 | 5/2009 | Dewald |
| 7,540,616 | B2 | 6/2009 | Conner |
| 7,567,040 | B2 | 7/2009 | Pong et al. |
| 7,598,682 | B2 | 10/2009 | Grajcar |
| 7,598,686 | B2 | 10/2009 | Lys et al. |
| 7,605,971 | B2 | 10/2009 | Ishii et al. |
| 7,626,755 | B2 | 12/2009 | Furuya et al. |
| 7,677,736 | B2 | 3/2010 | Kazasumi et al. |
| 7,684,007 | B2 | 3/2010 | Hull et al. |
| 7,703,943 | B2 | 4/2010 | Li et al. |
| 7,708,452 | B2 | 5/2010 | Maxik et al. |
| 7,709,811 | B2 | 5/2010 | Conner |
| 7,719,766 | B2 | 5/2010 | Grasser et al. |
| 7,728,846 | B2 | 6/2010 | Higgins et al. |
| 7,732,825 | B2 | 6/2010 | Kim et al. |
| 7,766,490 | B2 | 8/2010 | Harbers et al. |
| 7,819,556 | B2 | 10/2010 | Heffington et al. |
| 7,828,453 | B2 | 11/2010 | Tran et al. |
| 7,828,465 | B2 | 11/2010 | Roberge et al. |
| 7,832,878 | B2 | 11/2010 | Brukilacchio et al. |
| 7,834,867 | B2 | 11/2010 | Sprague et al. |
| 7,835,056 | B2 | 11/2010 | Doucet et al. |
| 7,841,714 | B2 | 11/2010 | Gruber |
| 7,845,823 | B2 | 12/2010 | Mueller et al. |
| 7,852,017 | B1 | 12/2010 | Melanson |
| 7,871,839 | B2 | 1/2011 | Lee et al. |
| 7,880,400 | B2 | 2/2011 | Zhoo et al. |
| 7,889,430 | B2 | 2/2011 | El-Ghoroury et al. |
| 7,902,769 | B2 | 3/2011 | Shteynberg et al. |
| 7,906,789 | B2 | 3/2011 | Jung et al. |
| 7,928,565 | B2 | 4/2011 | Brunschwiler et al. |
| 7,972,030 | B2 | 7/2011 | Li |
| 7,976,205 | B2 | 7/2011 | Grotsch et al. |
| 8,016,443 | B2 | 9/2011 | Falicoff et al. |
| 8,022,634 | B2 | 9/2011 | Greenfeld |
| 8,040,070 | B2 | 10/2011 | Myers et al. |
| 8,047,660 | B2 | 11/2011 | Penn et al. |
| 8,049,763 | B2 | 11/2011 | Kwak et al. |
| 8,061,857 | B2 | 11/2011 | Liu et al. |
| 8,070,302 | B2 | 12/2011 | Hatanaka et al. |
| 8,076,680 | B2 | 12/2011 | Lee et al. |
| 8,096,668 | B2 | 1/2012 | Abu-Ageel |
| 8,115,419 | B2 | 2/2012 | Given et al. |
| 8,188,687 | B2 | 5/2012 | Lee et al. |
| 8,212,494 | B2 | 7/2012 | Veltman et al. |
| 8,840,014 | B2 * | 9/2014 | Na ..... 235/375 |
| 8,893,968 | B2 * | 11/2014 | Jonsson ..... 235/385 |
| 2002/0175209 | A1 * | 11/2002 | Itoh ..... 235/462.25 |
| 2004/0052076 | A1 | 3/2004 | Mueller et al. |
| 2006/0002108 | A1 | 1/2006 | Ouderkirk et al. |
| 2006/0002110 | A1 | 1/2006 | Dowling et al. |
| 2006/0164005 | A1 | 7/2006 | Sun |
| 2006/0164607 | A1 | 7/2006 | Morejon et al. |
| 2006/0232992 | A1 | 10/2006 | Bertram et al. |
| 2006/0285193 | A1 | 12/2006 | Kimura et al. |
| 2007/0013871 | A1 | 1/2007 | Marshall et al. |
| 2007/0159492 | A1 | 7/2007 | Lo et al. |
| 2007/0188847 | A1 | 8/2007 | McDonald et al. |
| 2007/0241340 | A1 | 10/2007 | Pan |
| 2008/0143973 | A1 | 6/2008 | Wu |
| 2008/0198572 | A1 | 8/2008 | Medendorp |
| 2008/0232084 | A1 | 9/2008 | Kon |
| 2008/0258643 | A1 | 10/2008 | Cheng et al. |
| 2009/0009102 | A1 | 1/2009 | Kahlman et al. |
| 2009/0059099 | A1 | 3/2009 | Linkov et al. |
| 2009/0059585 | A1 | 3/2009 | Chen et al. |
| 2009/0128781 | A1 | 5/2009 | Li |
| 2009/0160370 | A1 | 6/2009 | Tai et al. |
| 2009/0175041 | A1 | 7/2009 | Yuen et al. |
| 2009/0200952 | A1 | 8/2009 | King et al. |
| 2009/0261748 | A1 | 10/2009 | McKinney et al. |
| 2009/0262516 | A1 | 10/2009 | Li |
| 2010/0006762 | A1 | 1/2010 | Yoshida et al. |
| 2010/0051976 | A1 | 3/2010 | Rooymans |
| 2010/0060181 | A1 | 3/2010 | Choi et al. |
| 2010/0061068 | A1 | 3/2010 | Geissler et al. |
| 2010/0061078 | A1 | 3/2010 | Kim |
| 2010/0072494 | A1 | 3/2010 | Lee |
| 2010/0103389 | A1 | 4/2010 | McVea et al. |
| 2010/0202129 | A1 | 8/2010 | Abu-Ageel |
| 2010/0213859 | A1 | 8/2010 | Shteynberg et al. |
| 2010/0231136 | A1 | 9/2010 | Reisenauer et al. |
| 2010/0231863 | A1 | 9/2010 | Hikmet et al. |
| 2010/0238001 | A1 * | 9/2010 | Veskovic ..... 340/10.42 |
| 2010/0244700 | A1 | 9/2010 | Chong et al. |
| 2010/0244724 | A1 | 9/2010 | Jacobs et al. |
| 2010/0270942 | A1 | 10/2010 | Hui et al. |
| 2010/0277067 | A1 | 11/2010 | Maxik et al. |
| 2010/0277084 | A1 | 11/2010 | Lee et al. |
| 2010/0302464 | A1 | 12/2010 | Raring et al. |
| 2010/0308738 | A1 | 12/2010 | Shteynberg et al. |
| 2010/0308739 | A1 | 12/2010 | Shteynberg et al. |
| 2010/0315320 | A1 | 12/2010 | Yoshida |
| 2010/0320927 | A1 | 12/2010 | Gray et al. |
| 2010/0320928 | A1 | 12/2010 | Kaihotsu et al. |
| 2010/0321641 | A1 | 12/2010 | Van Der Lubbe |
| 2010/0321933 | A1 | 12/2010 | Hatanaka et al. |
| 2011/0012137 | A1 | 1/2011 | Lin et al. |
| 2011/0176297 | A1 * | 7/2011 | Hsia et al. ..... 362/217.1 |
| 2011/0248640 | A1 | 10/2011 | Welten et al. |
| 2011/0267810 | A1 * | 11/2011 | Higman et al. ..... 362/218 |
| 2011/0309759 | A1 | 12/2011 | Shteynberg et al. |
| 2013/0068832 | A1 * | 3/2013 | Li et al. ..... 235/375 |
| 2013/0141011 | A1 * | 6/2013 | Fushimi ..... 315/294 |
| 2013/0201098 | A1 * | 8/2013 | Schilit et al. ..... 345/156 |
| 2014/0113598 | A1 * | 4/2014 | Conti ..... 455/414.1 |
| 2014/0239816 | A1 * | 8/2014 | Lee et al. ..... 315/130 |

OTHER PUBLICATIONS

U.S. Appl. No. 13/464,345, filed May 4, 2012, Holland et al.
Tannith Cattermole, "Smart Energy Glass controls light on demand", Gizmag.com, Apr. 18, 2010, accessed Nov. 1, 2011.
US 4,970,436, 11/1990, Sacchetti (withdrawn)
US 4,992,701, 02/1991, Sacchetti (withdrawn)

* cited by examiner

ZWM:LTUSA.COM:802.11g

WIRELESS PAIRING SYSTEM AND ASSOCIATED METHODS

RELATED APPLICATIONS

This application is related to and claims the benefit of U.S. Provisional Patent Application Ser. No. 61/486,315 titled INTELLIGENT WIRELESS PAIRING SYSTEM AND METHODS filed on May 15, 2011, and U.S. Provisional Patent Application Ser. No. 61/486,322 titled VARIABLE LOAD POWER SUPPLY filed on May 15, 2011, the entire contents of each of which are incorporated herein by reference. This application is also related to U.S. patent application Ser. No. 13/403,531 titled CONFIGURABLE ENVIRONMENTAL CONDITION SENSING LUMINAIRE, SYSTEM, AND ASSOCIATED METHODS filed Feb. 23, 2012, U.S. Pat. No. 7,708,452 titled LIGHTING APPARATUS INCLUDING FLEXIBLE POWER SUPPLY issued on May 4, 2010, and U.S. patent application Ser. No. 12/770,136 titled DIMMABLE LED LUMINAIRE filed Apr. 29, 2010, the entire contents of each of which are incorporated herein by reference.

FIELD OF THE INVENTION

The present invention relates to the field of wireless devices and, more specifically, to the field of wireless pairing devices that may be paired to a network, and associated methods.

BACKGROUND OF THE INVENTION

Configuring most consumer electronics to be paired with a network can sometimes be a challenging task. Often, the configuration process requires the user to have some understanding of electronics or IT protocols and technologies. This required understanding may make use of the consumer electronics inaccessible to many potential users.

A common example of potentially burdensome configuration of a consumer electronic product may include pairing a WiFi device to a network. The WiFi pairing process may be complicated when the device to be paired lacks an interface, such as a display or keyboard. To pair a consumer electronics device to a WiFi network it may be necessary to know which network to connect to, and also the type of encryption to use along with the cipher or password. The pairing process can be somewhat complicated if the device to be paired to the network does not have an interface for input of these parameters.

Previous attempts at solving this problem have required the user to first connect the device to a computer using other wired methods such as USB or Ethernet. This degrades the initial advantage of providing wireless connectivity on the device and also places additional hardware requirements on the user's configuration device, such as a PC.

Another method that has been set forth to attempt to address this problem involves writing proprietary protocols and software. In this method, the device may initially operate in a proprietary mode, wherein it may wait for a PC with which to communicate. The PC may run a program that places its WiFi interface into an alternate mode, which may inconveniently disconnect the PC from the existing wireless network. This common method for pairing of devices may often encounter hardware compatibility issues. Additionally, the software that runs on the PC must be very specific to the platform, meaning that versions must be written for all platforms supported.

As a result, there exists a need for a simple and intelligent wireless configuration system that may pair an electronic device to a network with minimal complexity. Additionally, there exists a need for an intelligent wireless configuration system that may pair an electronic device to a network without requiring cumbersome or proprietary protocols and interfaces.

SUMMARY OF THE INVENTION

With the foregoing in mind, the present invention advantageously provides a simple and intelligent wireless configuration system that may pair an electronic device to a network with minimal complexity. Additionally, the present invention advantageously provides an intelligent wireless configuration system that may pair an electronic device to a network without requiring cumbersome or proprietary protocols and interfaces.

These and other objects, features, and advantages according to the present invention are provided by a wireless pairing system having a network and a luminaire. The luminaire may include an electrical base, an enclosure, and a heat sink positioned between the electrical base and the enclosure. Additionally, the luminaire may also include a light source in electrical communication with the electrical base and positioned adjacent to the heat sink, a network interface in communication with the electrical base and the light source, and a controller in communication with the electrical base, the light source and the network interface. The controller may include a central processing unit (CPU), a memory, and an input/output (I/O) interface to control receipt and transmission of data. The luminaire may also include a camera in communication with the controller. The camera may include an image sensor and a camera output. The controller, the camera, the light source, and/or the network interface may be carried by the enclosure.

The camera may capture an image, which may include a configuration code associated with the network. The CPU may analyze the image to determine existence of the configuration code, and may also configure the network interface to connect the luminaire to the network using the configuration code. Once the luminaire is connected to the network, the luminaire may be operated or monitored through the network.

The light source may include a semiconductor lighting device, a laser, a light emitting diode (LED), and/or an infrared lighting device. The configuration code may be creatable using a configuration code generator which may have a user interface. Additionally, the configuration code generator may be in communication with the network. The configuration code associated with the network may be at least one of a one-dimensional barcode and a two-dimensional matrix barcode.

The network may be in communication with an additional device, and the luminaire may be controllable by the additional device. The additional device may have a control interface. The control interface of the additional device may be a computer-operable program and/or a mobile device application. The additional device may be a personal computer, a mobile phone, a tablet, a smartphone, a laptop, and/or a server. The camera output may be also accessible using the additional device.

The additional device and the luminaire may transmit and receive data using the network. An exchange of data between the luminaire and the additional device may be controllable using the I/O interface. Similarly, an exchange of data between the luminaire and the network may also be controllable using the I/O interface. A signal transmitted over the network may be receivable by the I/O interface, and the light source may be operable between an on state and an off state responsive to the signal.

The present invention also advantageously includes a method of operating a wireless pairing system. The method may include connecting a luminaire to a power source. The method may additionally include creating a configuration code associated with a network, capturing an image that may include the configuration code associated with the network, and analyzing the image to determine existence of the configuration code. The method may further include configuring the network interface to connect the luminaire to the network using the configuration code and performing at least one of operating and monitoring a status of the luminaire using the network.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Additionally, in the following detailed description, reference may be made to the recording of video images, or video recording. A person of skill in the art will appreciate that the use of "video recording" within this disclosure is not intended to be limited to the continuous capture of video frames at a high rate. More specifically, the use of "video recording" within this disclosure is intended to include low rate image capture, the capture of a series static images, processing of a single static image, or continuous capture of a video signal. Accordingly, skilled artisans should not view the following disclosure as limited to the capture of images at a specific frame rate, and should read broadly into the rate at which images may be captured.

Referring now to FIGS. 1-7, a wireless pairing system 15 having a luminaire 10 according to the present invention is now described in greater detail. Throughout this disclosure, the luminaire 10 may also be referred to as a device, wireless device, lighting device, or the invention. Alternate references of the luminaire 10 in this disclosure are not meant to be limiting in any way.

Figure 1:
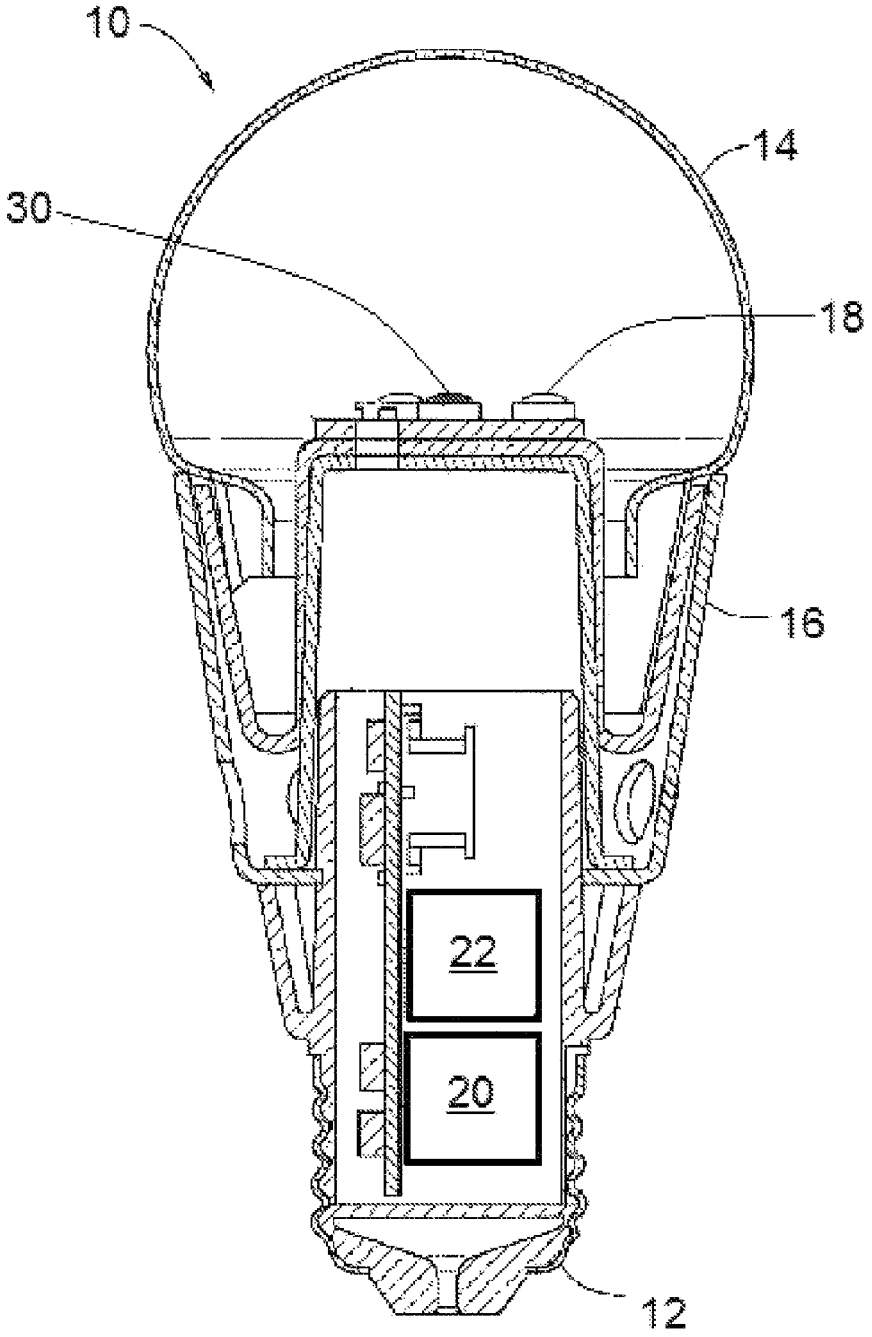
FIG. 1 is a cross-sectional view of a luminaire according to an embodiment of the present invention.
Figure 2:
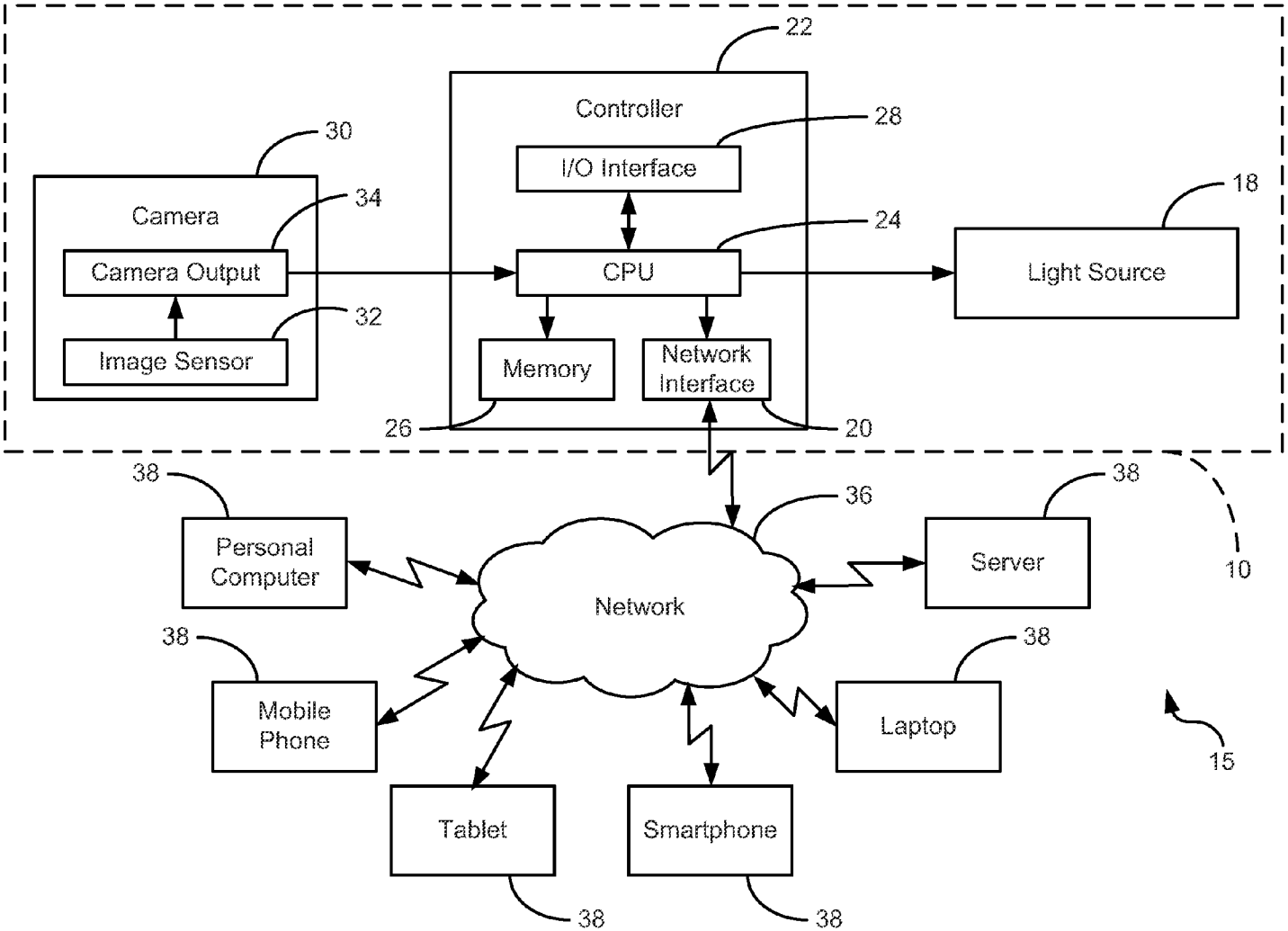
FIG. 2 is a block diagram of a wireless pairing system including the luminaire illustrated in FIG. 1 according to an embodiment of the present invention.

Referring now to FIGS. 1 and 2, a wireless pairing system 15 including a network 36 and a luminaire 10 will now be discussed. As perhaps best illustrated in FIG. 1, the luminaire 10 according to an embodiment of the present invention may include an electrical base 12, an enclosure 14, and a heat sink 16, which may be positioned between the electrical base 12 and the enclosure 14. Additional configurations of the electrical base 12, the enclosure 14, and the heat sink 16 of a luminaire 10 may readily come to mind of a skilled artisan having had the benefit of this disclosure, such as having the heat sink 16 positioned about the enclosure 14, or positioning the enclosure 14 between the heat sink 16 and the electrical base 12, and are intended to be included within the scope and spirit of the present invention. The electric base 12 may, for example, be an Edison type electric base, or any other type of base suitable for making electric contact with a power source, as understood by those skilled in the art.

Continuing to refer to FIG. 1, the luminaire 10 according to an embodiment of the present invention may additionally include a light source 18 in electrical communication with the electrical base 12, and may be positioned adjacent to the heat sink 16. Such positioning may have the advantage of increased efficiency of the light source 18, as well as a decreased risk of damage to the light source 18 and other nearby components. The luminaire 10 may additionally include a camera 30, a network interface 20 in communication with the electrical base 12 and the light source 18, and a controller 22 in communication with the electrical base 12, the light source 18, and the network interface 20. The network interface 20 may be a separate component from the controller 22, as illustrated in FIG. 1. However, the network interface 20 may alternately be included in the controller 22, as illustrated in FIG. 2, and as may be recognized by a skilled artisan. Any or all of the controller 22, the camera 30, the light source 18, and the network interface 20 may be carried by the enclosure 14. FIG. 1 illustrates the light source 18 and the camera 30 contained within the enclosure 14 as an example, and is not intended to be limiting in any way. More specifically, the present invention contemplates that the luminaire 10 may be provided without the use of an enclosure 14, i.e., wherein the camera 30 and the light source 18 are exposed.

Referring now to FIG. 2, the wireless pairing system 15 according to an embodiment of the present invention is shown. As FIG. 2 illustrates, the controller 22 may include a central processing unit (CPU) 24, a memory 26, and an input/output (I/O) interface 28 to control receipt and transmission of data. Additionally, the camera 30 may be in communication with the controller 22 and may include an image sensor 32 and a camera output 34. The controller 22 may be connected to the network 36 by the I/O interface 28 or the network interface 20, which will be discussed in greater detail below. The network 36 may also be connected to an additional device 38, which will also be discussed in greater detail below.

Figure 3:
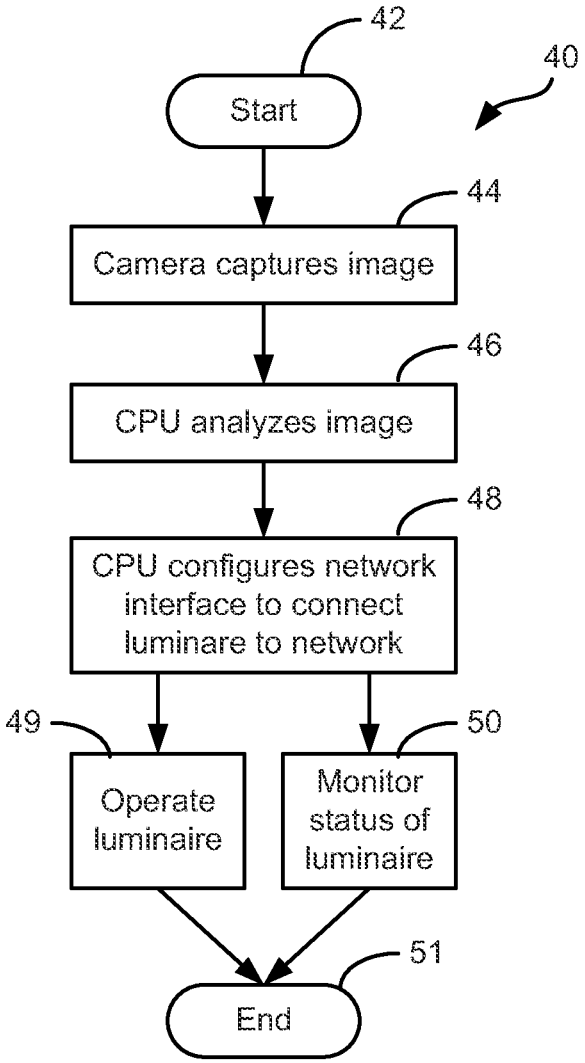
FIG. 3 is a flowchart illustrating a pairing process according to an embodiment of the present invention.

Referring now to flowchart 40 of FIG. 3, pairing the luminaire 10 to the network 36 will now be discussed. From the start (Block 42), the camera 30 captures an image having a configuration code associated with the network at Block 44. The CPU 24 may then analyze the image to determine existence of the configuration code at Block 46. The CPU may configure the network interface 20 to connect the luminaire 10 to the network 36 using the configuration code at Block 48. This may allow operating the luminaire 10 at Block 49 and/or monitoring a status of the luminaire 10 at Block 50, operations which may be controllable through the network 36. The pairing is completed at Block 51.

Figure 4:
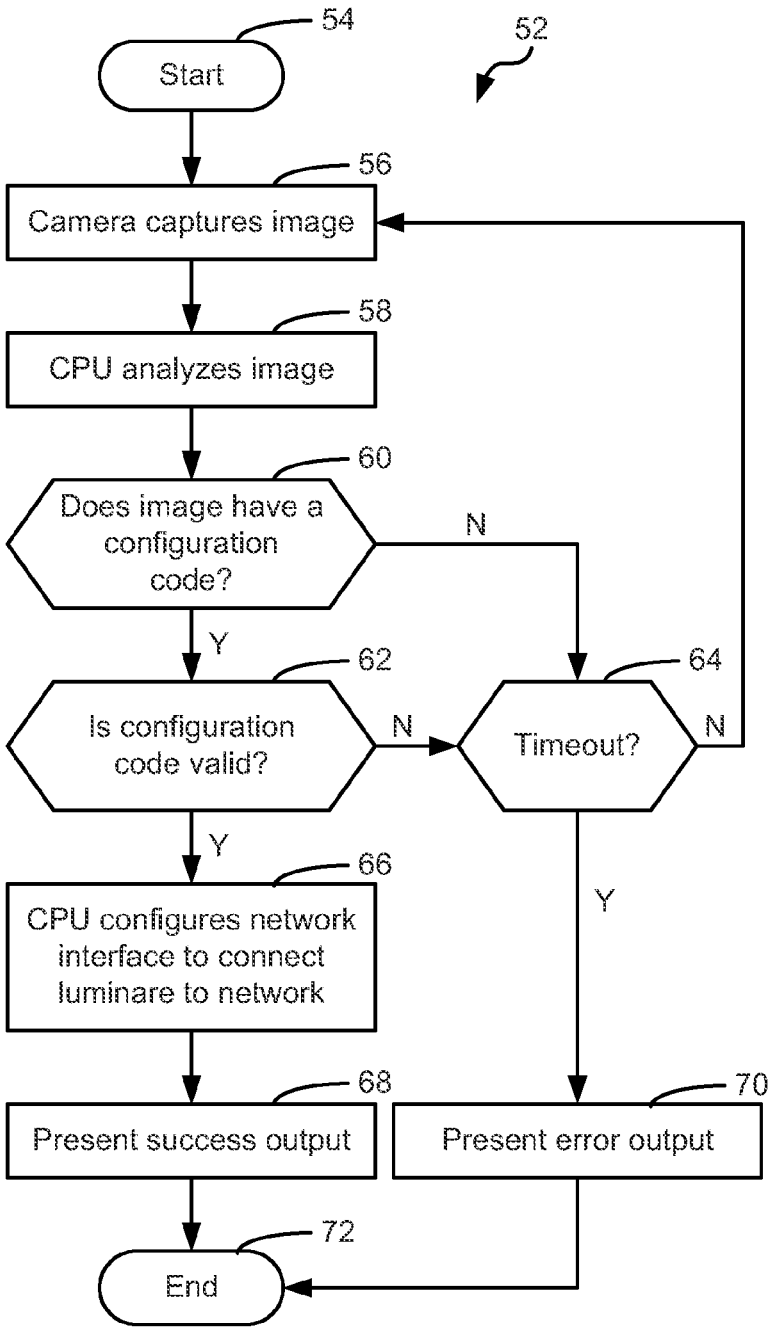
FIG. 4 is a flowchart illustrating the pairing process outlined in FIG. 3 showing image analysis outlined in greater detail according to an embodiment of the present invention.

Referring now to flowchart 52 of FIG. 4, analysis of the image captured by the camera 30 will be discussed in greater detail. Starting at Block 54, the camera 30 may capture an image at Block 56. The CPU 24 may then analyze the image at Block 58, checking if the image has a configuration code at Block 60. If it is determined that the image does not have a configuration code at Block 60, the CPU 24 may check to see if a timeout has occurred at Block 64, i.e., if a particular time has passed without it being determined that a configuration code is associated with the image captured. If a timeout has not occurred, the process returns to Block 56 wherein the camera 30 continues to capture images. If, however, it is determined that a timeout has occurred at Block 64, an error output may be presented at Block 70, ending the process at Block 72. If, however, a configuration code is present at Block 60, the CPU 24 may check the validity of the configuration code at Block 62. If the configuration code is not valid, the CPU 24 may check to see if a timeout has occurred at Block 64. If a timeout has not occurred, the process returns to Block 56 wherein the camera 30 continues to capture images. If, however, a timeout has occurred, an error output may be presented at Block 70, ending the process at Block 72.

If it is determined at Block 62 that the captured image has a configuration code associated therewith, the CPU 24 may configure the network interface 20 to connect the luminaire 10 to the network 36 at Block 66. A success output may then be presented at Block 68, ending the process at Block 72.

The success output may, for example, be an indication provided to a user that the luminaire 10 has been paired to the network. This can be provided in any number of ways. For example, the success output, or indication, may be provided on a user interface of a computing device. Further, the present invention contemplates the use of a mobile device application to aid in the pairing process, and the success output may be provided using a setting on the mobile device application. Similarly, a user's contact information may be associated with the network to which the luminaire 10 may be paired, and the present invention contemplates that the success output may be provided to the user using the user's contact information, e.g., via email, text message, sms message, etc. It is also contemplated, although not a preferred method, that the success output may actually be mailed to an address associated with either the location of the luminaire, the location of a network interface used to access the network, or any desired location.

The present invention additionally contemplates that the luminaire 10 may provide the success output. For example, and without limitation, the success output may be provided by the activation of the light source 18, or a lighting pattern from the light source 18. Alternatively, a basic sound output may be included in the luminaire 10 to provide the success output. A skilled artisan will readily recognize, after having had the benefit of this disclosure, that the error output may be delivered in any of the ways outlined above, as well as any other ways that may additionally come to mind of one skilled in the art having had the benefit of this disclosure.

The light source 18 may be provided by a semiconductor lighting device, a laser, a light emitting diode (LED), and/or an infrared lighting device. Multiple copies of a single device may make up the light source 18, or single copies of one or more of the devices listed may make up the light source 18. Additionally, other devices, such as CFL bulbs, and traditional light bulbs may make up the light source 18. It may be advantageous to have multiple copies of multiple devices make up the light source 18, particularly if one of the devices fails, or if a particular device may be more useful in a given situation. For instance, in a dark environment that requires a light that is imperceptible to the human eye, an infrared lighting device may be most advantageous.

As mentioned above, the light source 18 may be a semiconductor lighting device, a laser, a light emitting diode (LED), and/or an infrared lighting device. An LED may emit light when an electrical current is passed through the diode in the forward bias. The LED may be driven by the electrons of the passing electrical current to provide an electroluminescence, or emission of light. The color of the emitted light may be determined by the materials used in the construction of the light emitting semiconductor.

The light source 18 may emit a source light in various spectrums of light. For example, the light source 18 may emit a light in the visible spectrum. This visible light may advantageously illuminate an area to be recorded by the camera 30 and deter the presence of trespassers. In another example, the light source 18 may emit a light in the infrared spectrum. This infrared light may illuminate an area with an infrared light. Although the infrared light may not be visible to the human eye, it may be visible to a camera 30 that includes an image sensor 32 capable of detecting infrared light. The use of infrared light may advantageously allow the luminaire 10 of the present invention to monitor and detect motion in an area without visually illuminating the area.

A conversion coating may be applied to the light source 18 to create a desired output color. The inclusion of a conversion coating may advantageously allow the luminaire 10 of the present invention to include high efficiency LEDs, increasing the overall efficiency of the luminaire 10 according to an embodiment of the present invention. Additionally, conversion coatings may be applied, such as a conversion phosphor, delay phosphor, or quantum dot, to condition or increase the light outputted by the light source 18.

An example of the inclusion of a conversion coating will now be provided, without the intention to limit the luminaire 10 of the present invention. In this example, the source wavelength range of the light generated by the light source 18 may be emitted in a blue wavelength range. However, a person of skill in the art, after having the benefit of this disclosure, will appreciate that LEDs capable of emitting light in any wavelength ranges may be used in the lighting source 18, in accordance with this disclosure of the present invention. A skilled artisan will also appreciate, after having the benefit of this disclosure, additional light generating devices that may be used in the light source 18 that may be capable of creating an illumination.

Continuing with the present example of the light source 18 with a conversion coating applied, the light source 18 may generate a source light with a source wavelength range in the blue spectrum. The blue spectrum may include light with a wavelength range between 400 and 500 nanometers. A source light in the blue spectrum may be generated by a light emitting semiconductor that is comprised of materials that may emit a light in the blue spectrum. Examples of such light emitting semiconductor materials may include, but are not intended to be limited to, zinc selenide (ZnSe) or indium gallium nitride (InGaN). These semiconductor materials may be grown or formed on substrates, which may be comprised of materials such as sapphire, silicon carbide (SiC), or silicon (Si). A person of skill in the art will appreciate that, although the preceding semiconductor materials have been disclosed herein, any semiconductor device capable of emitting a light in the blue spectrum is intended to be included within the scope of the present invention.

The conversion coating may be a phosphor substance, which may be applied to the blue LEDs. The phosphorous substance may absorb wavelength ranges of emitted by the LEDs and emit light defined in additional wavelength ranges when energized. Energizing of the phosphor may occur upon exposure to light, such as the source light emitted from the light source 18. The wavelength of light emitted by a phosphor may be dependent on the materials from which the phosphor is comprised.

Figure 5:
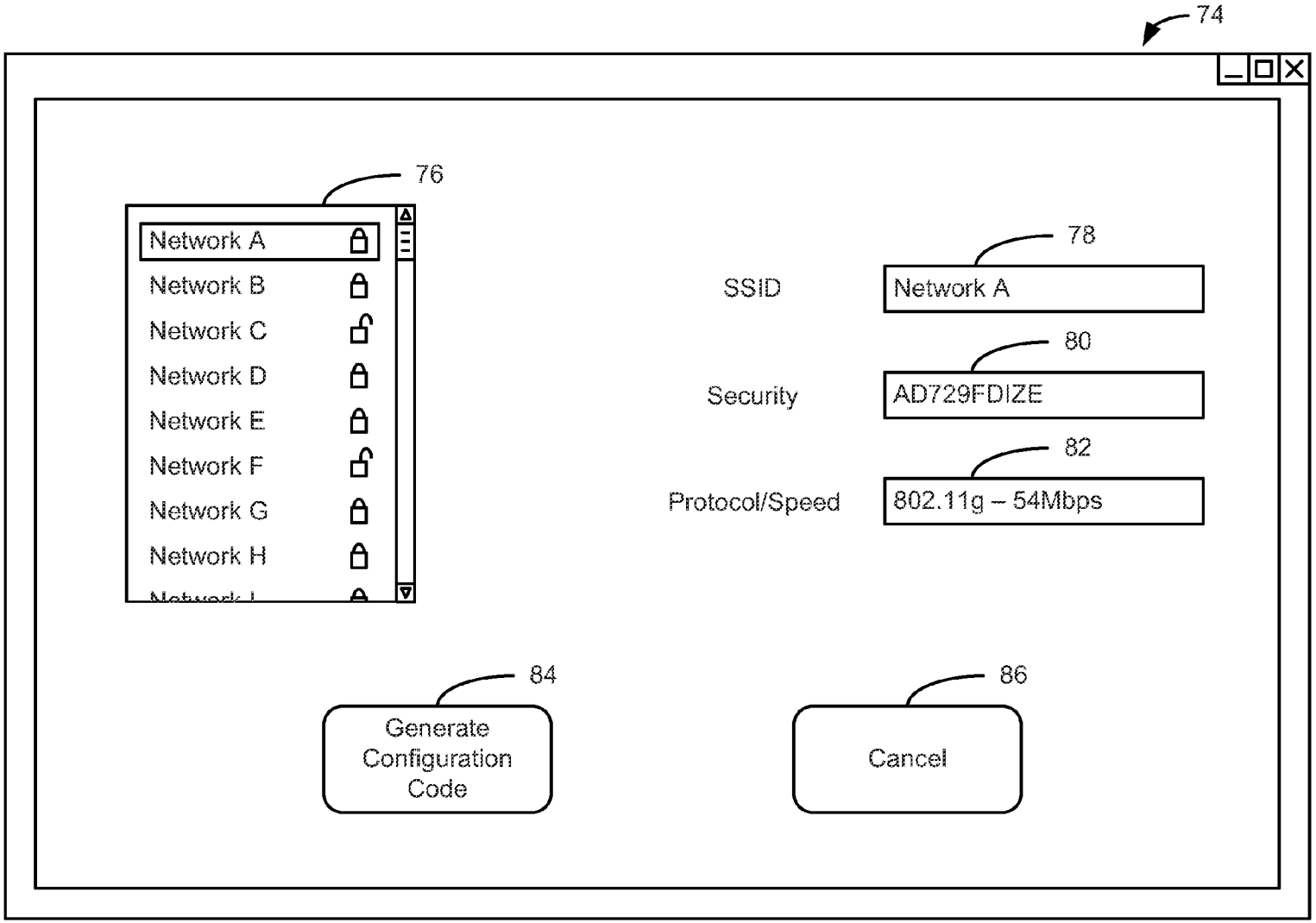
FIG. 5 is a schematic diagram of a user interface to generate a configuration code for wireless pairing according to an embodiment of the present invention.

The configuration code may be creatable using a configuration code generator having a user interface. Referring now to FIG. 5, an illustrative embodiment of a user interface and operation from which a configuration code may be generated will now be discussed. The diagram 74 of FIG. 5 illustrates a model user interface from which a user may generate a configuration code. The user interface may be presented to a user via an application, web interface, or other additional user interface that may allow a user to communicate with a computerized system.

Figure 6:
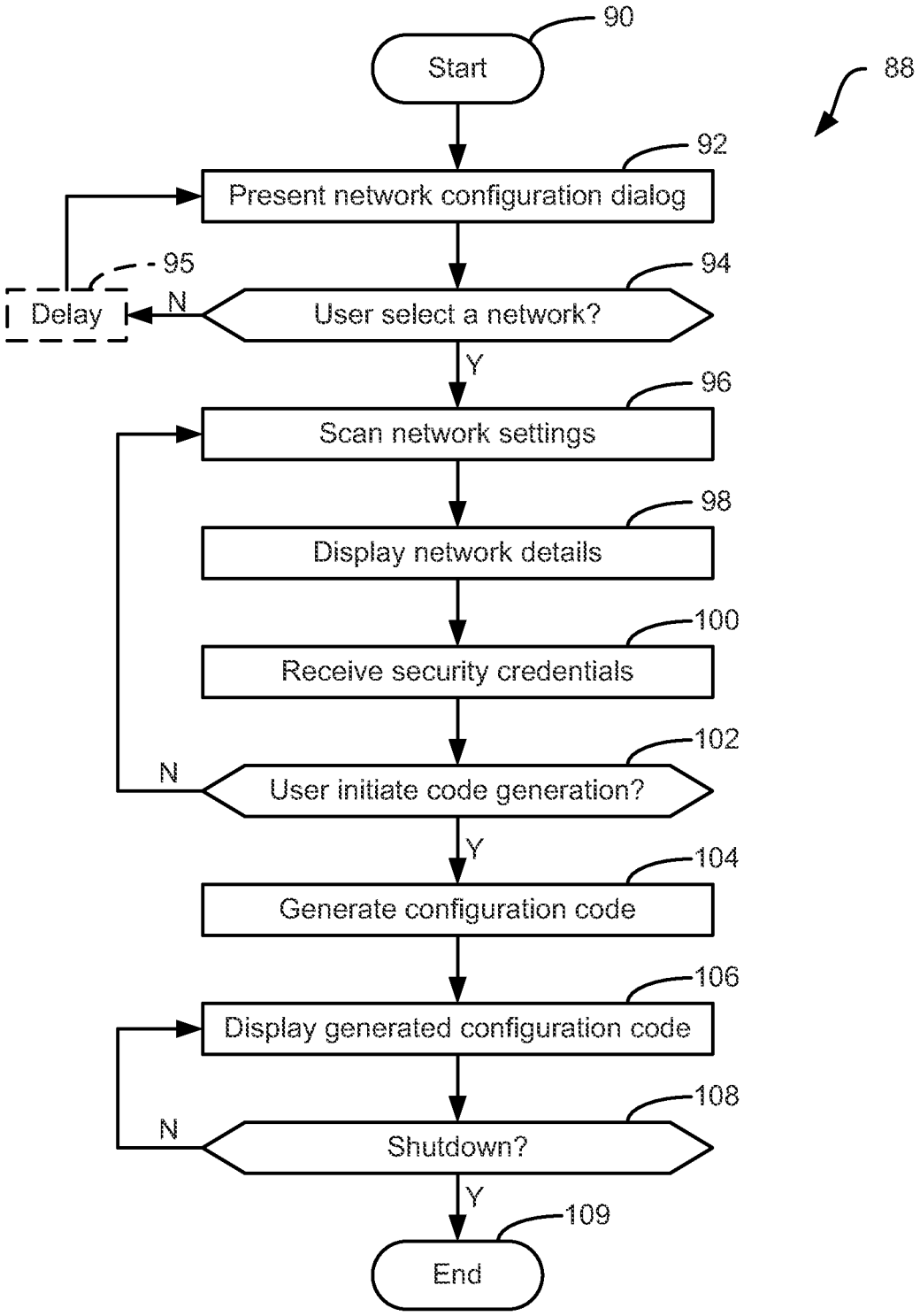
FIG. 6 is a flowchart illustrating a configuration code generation operation, according to an embodiment of the present invention.

Referring now additionally to flowchart 88 of FIG. 6, with respect to the user interface illustrated in diagram 74 of FIG. 5, an illustrative embodiment of generating a configuration code carried out a configuration code generator, using the luminaire 10 of the present invention, will now be discussed in greater detail. Starting at Block 88, the configuration code generator may present a user with a network configuration dialog (Block 90). The network configuration dialog may best be illustrated by diagram 74 of FIG. 5. As mentioned above, the network configuration dialog may be presented to the user as a web interface that may be accessed via a network 36, such as, for example, the Internet. That is, the configuration code generator may be in communication with the network 36. Additionally, the network configuration dialog may be included in an application that may be run on any computerized device, such as a smartphone or a personal computer. In the network configuration dialog, a network list 76 may be presented to the user. The user may select a desired network from the network list 76.

The configuration code generator may then determine whether a user has selected a network (Block 94). If no network has been selected, the configuration code generator may optionally perform a delay operation (Block 95). The configuration code generator may then return to the operation of Block 92, wherein it may continue to present the network configuration dialog to the user.

If the user has selected a network 36 from the network list 76, the configuration code generator may scan the network settings for the selected network (Block 96). The configuration code generator may then analyze the network settings to determine network details. The configuration code generator may display the network details to the user. (Block 98). Network details may include, for example, service set identifier (SSID) information 78, the security protocol 80 being used, transmission speed 82 of the network 36, or various other network details that will be appreciated by a person of skill in the art.

Upon displaying the network details, the configuration code generator may receive security credentials that may be used to configure the network (Block 100). The security credentials may be entered through any process that may result in the configuration code generator receiving the security credentials, such as by entering a code in box 80 of the network configuration dialog 74. In one example, the security credentials may be entered by a user. In another example, the security credentials may be determined by analyzing the credentials for the current connection that may exist between the computerized system, which may be operating the configuration code generator, and the network 36, to which the computerized system may be connected.

The configuration code generator may next determine whether the user has initiated the configuration code generation operation (Block 102). A user may initiate the code generation operation, for example, without limitation, by engaging a "generate configuration code" button 84. If the configuration code generation operation has not been initiated, the configuration code generator may return to the operation of Block 96. Conversely, if the configuration code generation operation has been initiated at Block 102, the configuration code may be generated (Block 104).

The configuration code generator may then display the configuration code (Block 106). As would be appreciated by a person of skill in the art, the configuration code may be displayed in any manner from which it may be detected by the luminaire 10 of the present invention. In one example, the configuration code may be displayed on the screen of a mobilized computing device, such as a smartphone. In another example, the configuration code may be printed onto a sheet of paper. A skilled artisan will appreciate that the manner in which the configuration code may be displayed should not be limited to the aforementioned examples.

After the configuration code has been displayed, the configuration code generator may determine whether a shutdown command has been received (Block 108). If no shutdown command has been received, the configuration code generator may continue to display the configuration code, as described at Block 106. If, however a shutdown command has been received at the operation of Block 108, the program may terminate (Block 109).

Additionally, a cancel button 86 may be included in the configuration code generation dialog. Upon selecting or engaging the cancel button 86, the configuration code generator may operate as if a shutdown command has been received, as described at Block 109.

Once a configuration code has been generated, it may be used to configure the luminaire 10 of the present invention. The configuration code associated with the network may be at least one of a one-dimensional barcode and a two dimensional matrix barcode, such as a QR code.

Figure 7A:
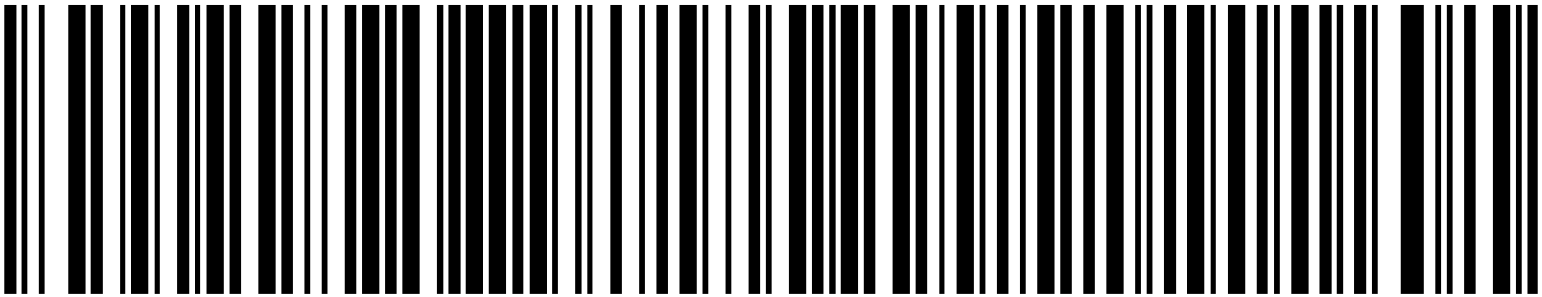
FIGS. 7A and 7B are examples of configuration codes to be used to carry out a pairing process according to an embodiment of the present invention.
Figure 7B:
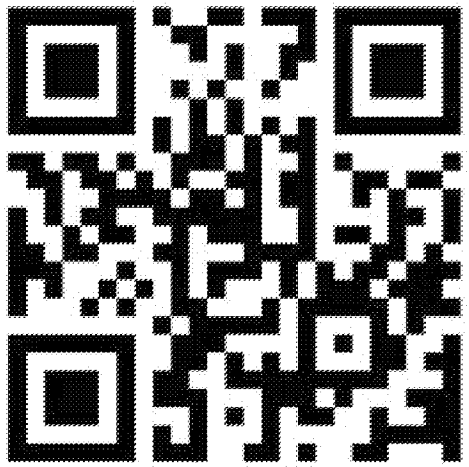

Referring now to FIGS. 7A and 7B, different types of barcodes that may make up the configuration code will now be discussed. As will be recognized by a skilled artisan, a barcode is an optical representation of data that may be readable by a machine. The data may read by a laser-driven optical scanner, camera, or other computerized device capable of receiving optical information. There are currently two major types of barcodes: one-dimensional barcodes, as shown in FIG. 7A, and two-dimensional matrix barcodes, shown in FIG. 7B. The two-dimensional matrix barcode shown in FIG. 7B is often referred to as a quick response (QR) code. Additional two-dimensional matrix barcodes exist, and may include geometric patterns other than squares, such as triangles, dots, or hexagons, as well as color coded information. A two-dimensional barcode may also be made by stacking one-dimensional barcodes atop each other.

A barcode for use in the present invention may include direct information regarding configuration, such as a complete list of configuration credentials, or a network name and password. Many additional information sets may be included in the scope and spirit of the present invention, such as contact information for a success output, and are intended to be included herein.

As previously mentioned above, the network 36 may be in communication with an additional device. The luminaire 10 is controllable by the additional device 38, and the additional device 38 may have a control interface. The control interface of the additional device 38 may be, for instance, a computer-operable program or a mobile device application. Additionally, it may be appreciated that the configuration code generator and the additional device 38 may alternatively be embodied as a single device. The additional device 38 may be provided by a personal computer, a mobile phone, a tablet, a smartphone, a laptop, or a server.

Controlling the luminaire 10 using a plurality of additional devices 38 may be advantageous. For example, and without limitation, the luminaire 10 may be operated using the personal computer at home, the laptop at a place of work, the tablet throughout multiple rooms in a building utilizing the present invention, and the mobile phone and the smartphone from any location the user may happen to be. The server may, for instance, be used by a company that may monitor luminaires 10. Additional devices, locations, and circumstances are intended to be included within the scope and spirit of the present invention, and may readily come to minds of such skilled persons having the benefit of this disclosure. The camera output 34 may be accessible using the additional devices 38 listed above. This may be particularly advantageous for users who wish to monitor activity around the wireless pairing system 15. The additional device 38 and the luminaire 10 may transmit and receive data using the network 36, which may facilitate accessing the camera output 34 or a status of the luminaire 10. An exchange of data between the luminaire 10 and the additional device 38 in communication with the network 36 may be controllable using the I/O interface 28, particularly in the event of controlling the luminaire 10.

More generally, an exchange of data between the luminaire 10 and the network 36 may be controllable using the I/O interlace 28. That is, data exchanges need not necessarily be tied to the additional device 38. For instance, more than one luminaire 10 may be in communication with another luminaire 10 over the network 36. Such an exchange of data may be controllable using the I/O interface 28. Further, a signal transmitted over the network 36 may be receivable by the I/O interface 28, and may cause the light source 18 to be operable between an on state and an off state responsive to the signal. Additional operative commands relating to the luminaire 10, including, but not limited to record, reset, or pair to another network, may also cause a change in operation of the luminaire 10 or parts thereof.

It should be noted that, in this context, that operation of light source 18 between an on state and an off state responsive to the signal may be any brightness of the light source 18, inclusive. That is, the light source may be dimmable from its maximum light output, or on state, to a minimal, or no light output, which may be recognized as the off state.

The present invention may additionally be provided for by a luminaire 10 as discussed above. That is, a luminaire 10 having an electrical base 12, an enclosure 14, and a heat sink 16 positioned between the electrical base 12 and the enclosure 14, as well as a light source 18 in electrical communication with the electrical base 12 and positioned adjacent to the heat sink 16. A network interface 20 may be in communication with the electrical base 12 and the light source 18. A controller 22 may be in communication with the electrical base 12, the light source 18 and the network interface 20.

As previously stated, and as perhaps best illustrated in FIG. 2, the controller may include a CPU 24, memory 26, and an I/O interface 28. The CPU 24 may be configured to receive a data signal from additional components of the luminaire 10, such as the camera 30 or the network interface 20.

The CPU 24 may compute and perform calculations to the data received by the additional components. As a non-limiting example, and previously discussed, the CPU 24 may receive a series of image captures, or frames, from the camera 30. The CPU 24 may analyze the frames to determine whether a configuration code may exist in one or more of the frames. If it is determined that a configuration code exists within a frame, the CPU 24 may configure the network interface 20 with respect to the configuration parameters included in the configuration code.

The controller 22 may also include memory 26. The memory 26 may include volatile and non-volatile memory modules. Volatile memory modules may include random access memory, which may temporarily store data and code being accessed by the CPU 24. The non-volatile memory may include flash based memory, which may store the computerized program that may be operated on the CPU 24, as well as images or video that may be captured by the camera 30 during operation of the luminaire 10.

Additionally, the memory 26 may include computerized code used by the CPU 24 to control operation of the luminaire 10. The memory 26 may also store feedback information related to operation of additional components included in the luminaire 10. In an embodiment of the present invention, the memory 26 may include an operating system, which may additionally include applications that may be run within the operating system, which will be appreciated by a person of skill in the art.

The controller 22 may also include an I/O interface 28. The I/O interface 28 may control the receipt and transmission of data between the controller 22 and additional components. Provided as a non-limiting example, the I/O interface 28 may receive a data communication signal from the camera 30, which may further include a plurality of video frames. After the CPU has analyzed the video frames, the I/O interface 28 may transmit a signal to illuminate a light source 18.

The luminaire 10 may additionally include a camera 30 in communication with the controller 22 and comprising an image sensor 32 and a camera output 34. At least one of the controller 22, the camera 30, the light source 18, and the network interface 20 may be carried by the enclosure 14. The camera 30 may record an electronic video image of an area at which it is directed. The camera 30 may be capable of recording a series of images in incremental or rapid succession. These captured images may then be compiled into a motion picture, or a video image.

The camera 30 may include a lens in addition to a video or image sensor 32. The lens may be a substantially transparent structure located adjacent to the image sensor 32 that may focus the light received by the camera 30. The lens may be constructed from any material that may allow light to pass, such as clear plastic or glass. By adjusting the characteristics of the lens, the depth of field of the frames captured by the camera 30 may be adjusted, advantageously allowing the size of the camera 30 to be reduced while providing a high image quality.

The image sensor 32 of the camera may be a semiconductor based image detecting device, such as a CMOS or CCD sensor. A person of skill in the art will appreciate additional, non-semiconductor based image detecting devices that would be included within the scope and spirit of the present invention.

The term CMOS is an abbreviation for a complementary metal-oxide-semiconductor. A CMOS based image sensor 32 may be characteristically defined by high noise immunity and low static power consumption, advantageously resulting in increased efficiency during operation. The term CCD is an abbreviation for a charge-coupled device. The CCD may be integrated with photoelectric devices to provide image sensing capabilities which may advantageously produce high resolution images.

The image sensor 32 may detect and record frames sensed in the infrared spectrum of light. The recording of infrared frames may occur in addition to recording frames in the visible spectrum of light. In this embodiment, the luminaire 10 may additionally include an infrared light source, which may emit a light that is visible to the image sensor 32 but not the human eye. Such an infrared light source may, for example, be an infrared LED.

The camera 30 may also include internal circuitry, which may additionally be used during operation of the camera 30. The additional circuitry may condition an electrical current from a power source into an electrical current usable by the camera 30. The additional circuitry may also include components to transmit the recorded frames or images to the CPU 24 for further processing and analysis, as would be understood by a person of skill in the art.

As mentioned above, the light source 18 may be a semiconductor lighting device, a laser, light emitting diode (LED), and/or an infrared lighting device. Also mentioned previously, the camera 30 may capture an image having a configuration code associated with a network 36, and the CPU 24 may analyze the image to determine existence of the configuration code. Finally, the CPU 24 may configure the network interface 20 to connect the luminaire 10 to the network 36 using the configuration code so that operating and/or monitoring a status of the luminaire 10 is controllable through the network 36.

An embodiment of an additional device 38 may include a computerized device capable of running computer programs. More specifically, the computerized device may be connected to the network 36 to perform one or more steps which may result in the display of the camera output 34 on a screen or display interface. The additional device 38 may include, but not be limited to, a server, a computer (i.e., desktop computer, laptop computer, netbook computer, or any machine having a processor), a dumb terminal that provides an interface with a computer or server, a personal digital assistant, mobile communications device, such as a cellular phone, smart phone (such as an Google Android based phone), a data center, or other similar device that provides computer or quasi-computer functionality. The network communication may occur through an internal network, an intranet, LAN, WAN, or global communications network (such as the Internet). Additionally, the additional device 38 may take direction from or engage in processes which are then delivered to the luminaire 10 of the present invention. It should be noted that the method aspects of the present invention are preferably computer-implemented methods and, more particularly, at least one step is preferably carried out using a computerized device.

Figure 8:
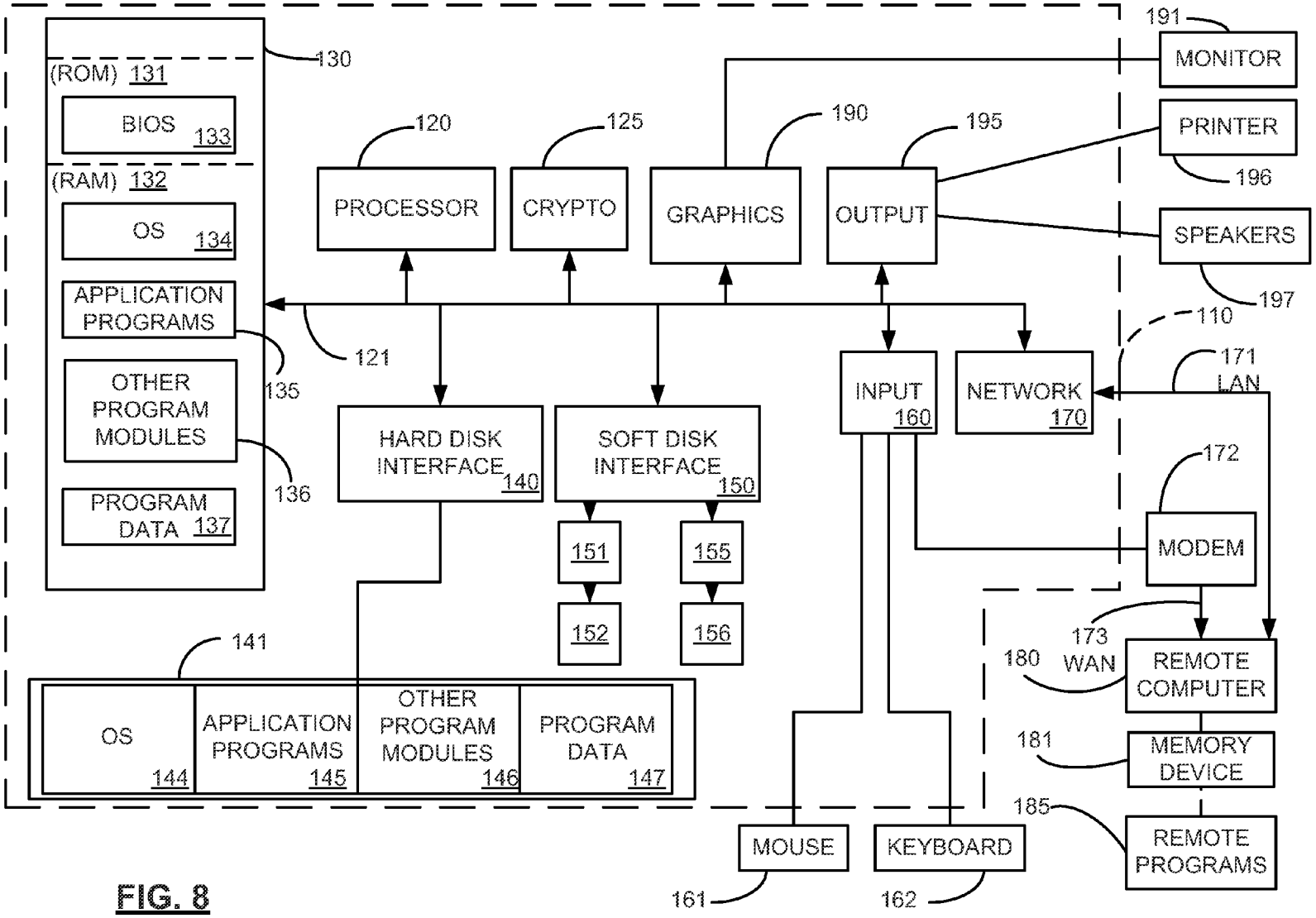
FIG. 8 is a block diagram of a model computing device for use with the luminaire according to an embodiment of the present invention.

As such, one or more of the aspects of the present invention may be performed on a computing device. More specifically, the luminaire 10 according to an embodiment of the present invention may be tied to a machine or apparatus such as a computing device, particularly the additional device 38. The skilled artisan will also note that a computing device may be understood to be any device having a processor, memory unit, input, and output. This may include, but is not intended to be limited to, cellular phones, smart phones, tablet computers, laptop computers, desktop computers, personal digital assistants, etc. FIG. 8 illustrates a model computing device in the form of a computer 110, which is capable of performing one or more computer-implemented steps in practicing the method aspects of the present invention. Components of the computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI).

The computer 110 may also include a cryptographic unit 125. Briefly, the cryptographic unit 125 has a calculation function that may be used to verify digital signatures, calculate hashes, digitally sign hash values, and encrypt or decrypt data. The cryptographic unit 125 may also have a protected memory for storing keys and other secret data. In other embodiments, the functions of the cryptographic unit may be instantiated in software and run via the operating system.

A computer 110 typically includes a variety of computer readable media. Computer readable media can be any available media that can be accessed by a computer 110 and includes both volatile and nonvolatile media, removable and non-removable media. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 8 illustrates an operating system (OS) 134, application programs 135, other program modules 136, and program data 137.

The computer 110 may also include other removable/non-removable, volatile nonvolatile computer storage media. By way of example only, FIG. 8 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable non-removable, volatile/non-volatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives, and their associated computer storage media discussed above and illustrated in FIG. 8, provide storage of computer readable instructions, data structures, program modules and other data for the computer 110. In FIG. 8, for example, hard disk drive 141 is illustrated as storing an OS 144, application programs 145, other program modules 146, and program data 147. Note that these components can either be the same as or different from OS 134, application programs 135, other program modules 136, and program data 137. The OS 144, application programs 145, other program modules 146, and program data 147 are given different numbers here to illustrate that, at a minimum, they may be different copies. A user may enter commands and information into the computer 110 through input devices such as a keyboard 162 and cursor control device 161, commonly referred to as a mouse, trackball or touch pad. Other input devices (not shown) may include a microphone, joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a graphics controller 190. In addition to the monitor, computers may also include other peripheral output devices such as speakers 197 and printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 8. The logical connections depicted in FIG. 8 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 8 illustrates remote application programs 185 as residing on memory device 181.

The communications connections 170 and 172 allow the device to communicate with other devices. The communications connections 170 and 172 are an example of communication media. The communication media typically embodies computer readable instructions, data structures, program modules or other data in a modulated data signal such as a carrier wave or other transport mechanism and includes any information delivery media. A "modulated data signal" may be a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media may include both storage media and communication media.

Figure 9:
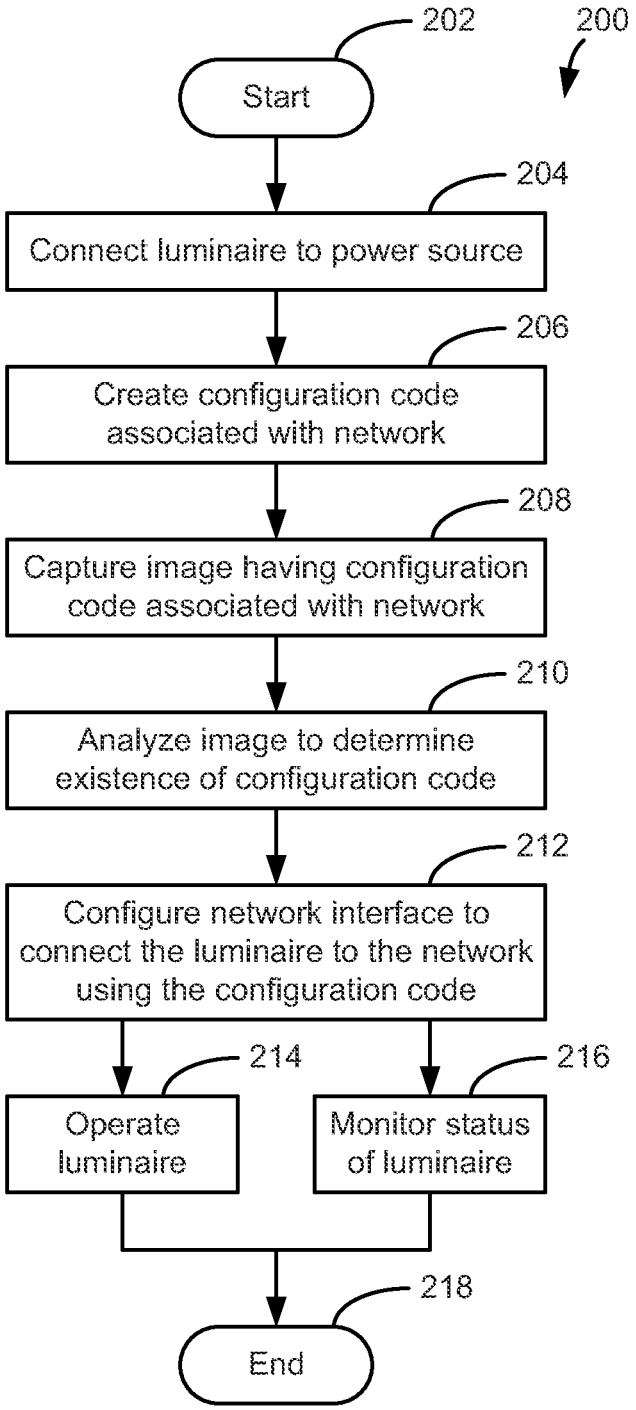
FIGS. 9-15 are flowcharts illustrating alternate methods of pairing a luminaire to a network and operating the luminaire according to embodiments of the present invention.

Referring now to flowchart 200 of FIG. 9, a method of operating a wireless pairing system 15 will now be discussed. Starting at Block 202, a user may connect a luminaire 10 to a power source (Block 204). The luminaire 10 may include an electrical base 12, an enclosure 14, and a heat sink 16 positioned between the electrical base 12 and the enclosure 14. The luminaire 10 may also include a light source 18 in electrical communication with the electrical base 12 and positioned adjacent to the heat sink 16, a network interface 20 in communication with the electrical base 12 and the light source 18, and a controller 22 in communication with the electrical base 12, the light source 18, and the network interface 20. The controller 22 may include a CPU 24, a memory 26, and an I/O interface 28 to control receipt and transmission of data. The luminaire 10 may also include a camera 30 in communication with the controller 22 and having an image sensor 32 and a camera output 34.

Once the luminaire 10 is connected to a power source, a user may create a configuration code associated with a network 36 (Block 206), and capture an image having the configuration code associated with the network 36 (Block 208).

The method may then include analyzing the image to determine existence of the configuration code at Block 210. From there, the CPU 24 may configure the network interface 20 to connect the luminaire 10 to the network 36 using the configuration code (Block 212). A user may then operate the luminaire 10 (Block 214), and/or monitor a status of the luminaire 10 (Block 216) using the network 36, ending the process at Block 218.

As will be recognized by a skilled artisan having had the benefit of this disclosure, the status of a luminaire 10 may include the operational status of its components. That is, whether the camera 30, light source 18, and other includable components, are off, on, functioning, malfunctioning, or any other status that may describe the operational state of a component, or the whole luminaire 10. The status of the luminaire 10 may be transmitted over the network to an additional device 38, or to another luminaire 10. Additionally, the status of the luminaire 10 may be displayed on a user interface of an additional device 38.

Referring back to FIG. 9, the step of creating the configuration code (Block 206) may be performable using a configuration code generator having a user interface. Additionally, the configuration code generator may be in communication with the network 36. The configuration code associated with the network 36 may be at least one of a one-dimensional barcode and a two-dimensional matrix barcode, as illustrated in FIGS. 7A and 7B. The configuration code types have been discussed at length above, and require no further discussion herein.

Figure 10:
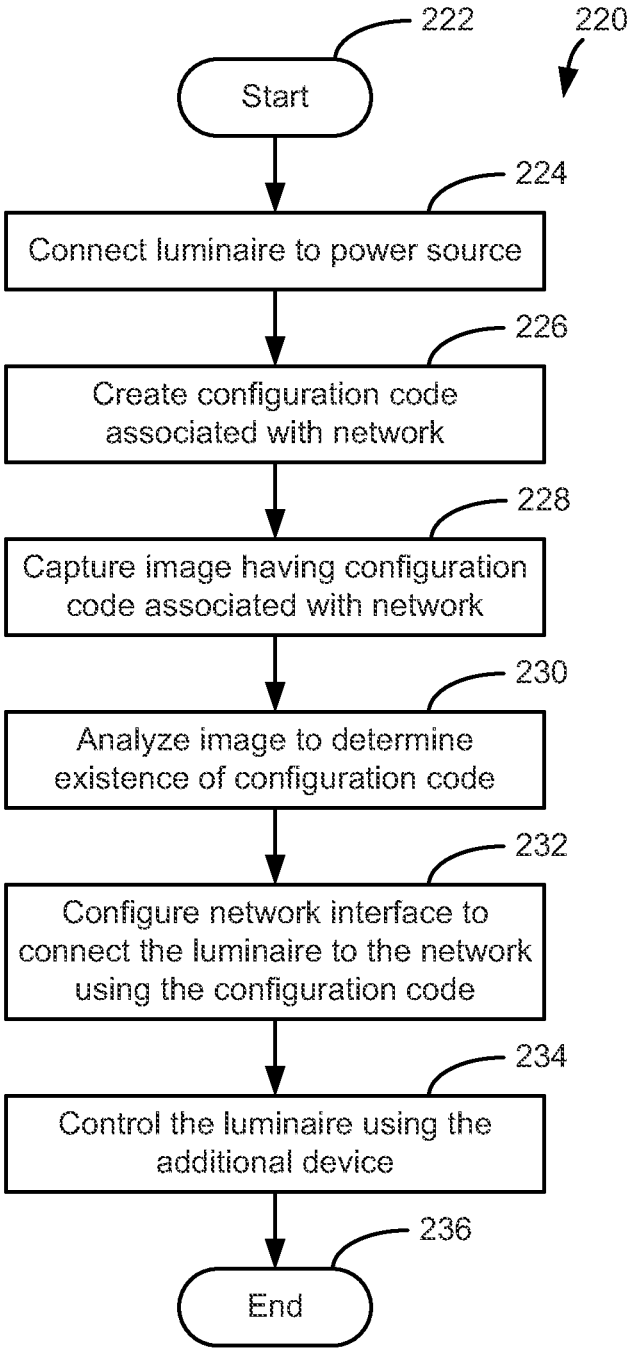

The network 36 may be in communication with at least one additional device 38. Referring now to flowchart 220 of FIG. 10, such a method will now be discussed. Starting at Block 222, a user may connect a luminaire 10 to a power source (Block 224). Once the luminaire 10 is connected to a power source, a user may create a configuration code associated with a network 36 (Block 226), and the camera 30 may capture an image having the configuration code associated with the network 36 (Block 228). The method may then include the CPU 24 analyzing the image to determine existence of the configuration code at Block 230. From there, the CPU 24 may configure the network interface 20 to connect the luminaire 10 to the network 36 using the configuration code (Block 232). A user may then control the luminaire 10 using the additional device 38 (Block 234), ending the process at Block 236.

The additional device 38 may include a control interface, which may be of a computer-operable program and/or a mobile device application. Additionally, the additional device 38 may be a personal computer, a mobile phone, a tablet, a smartphone, a laptop, and/or a server. Computerized devices have been discussed at length above, and require no further discussion herein.

Figure 11:
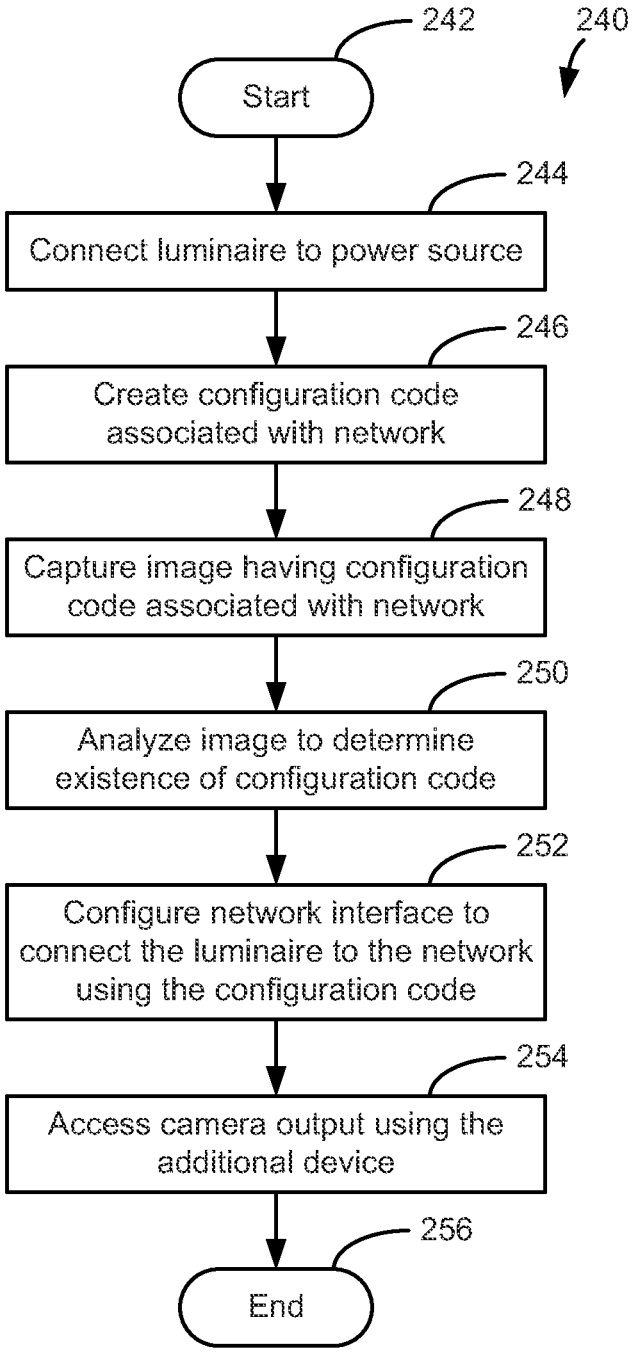

Referring now to flowchart 240 of FIG. 11, an additional method using the additional device 38 according to an embodiment of the present invention will now be discussed. Starting at Block 242, a user may connect a luminaire 10 to a power source (Block 244). Once the luminaire 10 is connected to a power source, a user may create a configuration code associated with a network 36 (Block 246), and the camera 30 may capture an image having the configuration code associated with the network 36 (Block 248). The method may then include the CPU 24 analyzing the image to determine existence of the configuration code at Block 250. From there, the CPU 24 may configure the network interface 20 to connect the luminaire 10 to the network 36 using the configuration code (Block 252). A user may then access the camera output 34 using the additional device 38 (Block 254), ending the process at Block 256.

Figure 12:
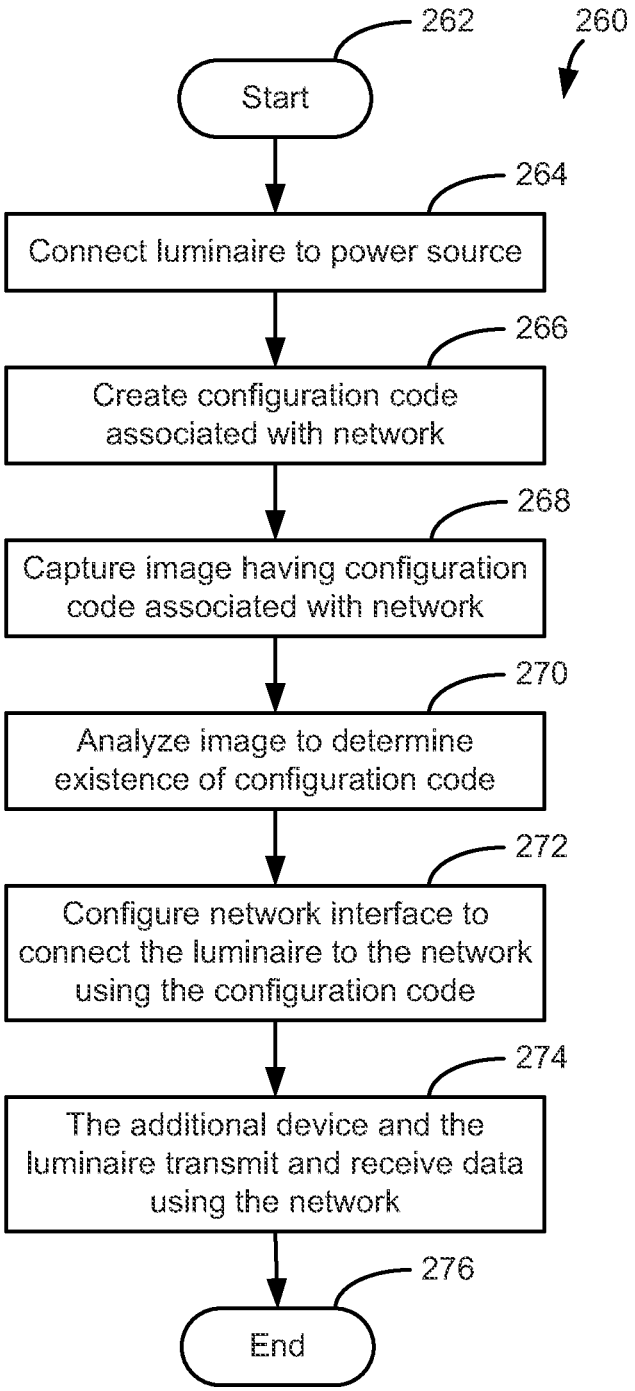

Referring now to flowchart 260 of FIG. 12, an additional method using the additional device 38 according to an embodiment of the present invention will now be discussed. Starting at Block 262, a user may connect a luminaire 10 to a power source (Block 264). Once the luminaire 10 is connected to a power source, a user may create a configuration code associated with a network 36 (Block 266), and the camera 30 may capture an image having the configuration code associated with the network 36 (Block 268). The method may then include the CPU 24 analyzing the image to determine existence of the configuration code at Block 270. From there, the CPU 24 may configure the network interface 20 to connect the luminaire 10 to the network 36 using the configuration code (Block 272). The additional device 38 and the luminaire 10 may then transmit and/or and receive data using the network 36 (Block 274), ending the process at Block 276.

Figure 13:
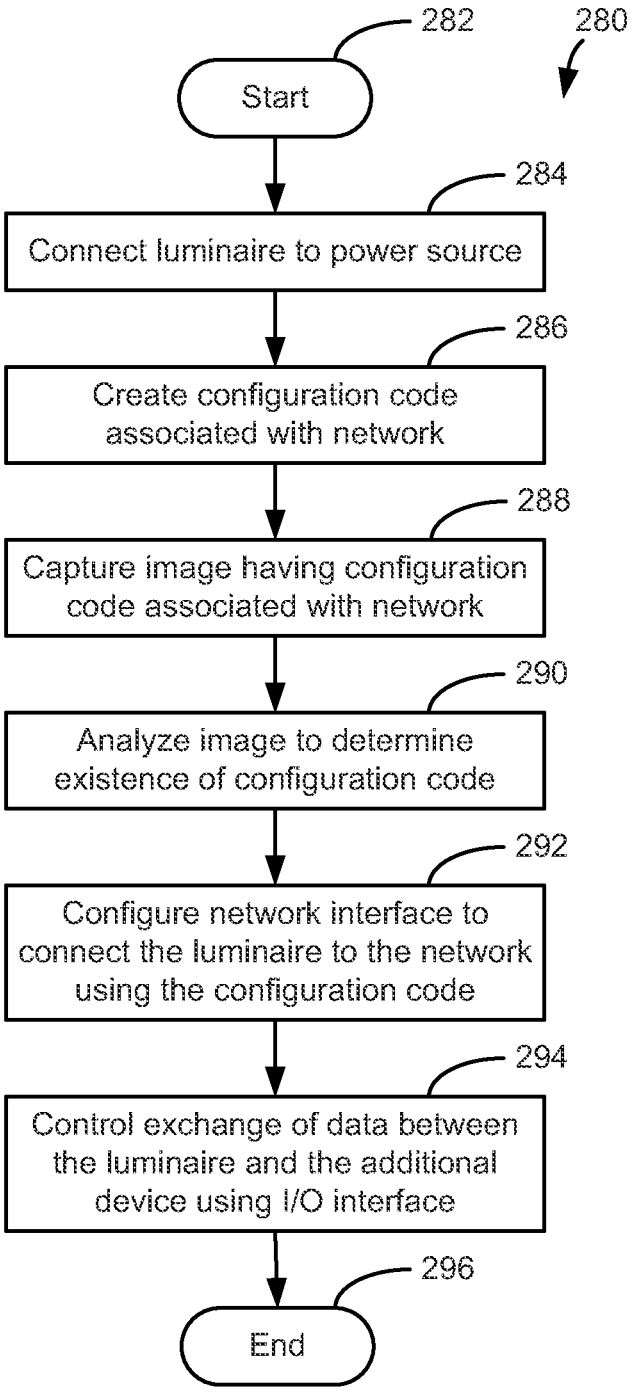

Referring now to flowchart 280 of FIG. 13, yet another method using the additional device 38 according to an embodiment of the present invention will now be discussed. Starting at Block 282, a user may connect a luminaire 10 to a power source (Block 284). Once the luminaire 10 is connected to a power source, a user may create a configuration code associated with a network 36 (Block 286), and the camera 30 may capture an image having the configuration code associated with the network 36 (Block 288). The method may then include the CPU 24 analyzing the image to determine existence of the configuration code at Block 290. From there, the CPU 24 may configure the network interface 20 to connect the luminaire 10 to the network 36 using the configuration code (Block 292). The I/O interface 28 may then control an exchange of data between the luminaire 10 and the additional device 38 in communication with the network 36 (Block 294), ending the process at Block 296.

Figure 14:
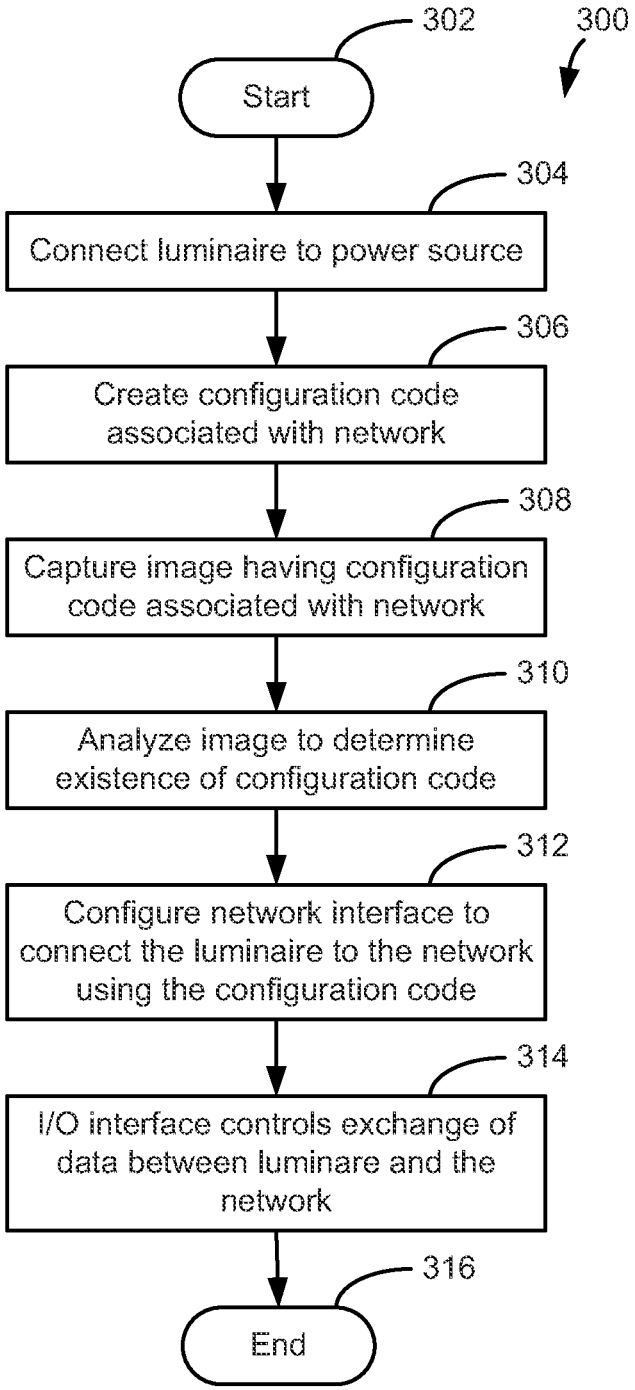

Referring now to flowchart 300 of FIG. 14, another method using the additional device 38 according to an embodiment of the present invention will now be discussed. Starting at Block 302, a user may connect a luminaire 10 to a power source (Block 304). Once the luminaire 10 is connected to a power source, a user may create a configuration code associated with a network 36 (Block 306), and the camera 30 may capture an image having the configuration code associated with the network 36 (Block 308). The method may then include the CPU 24 analyzing the image to determine existence of the configuration code at Block 310. From there, the CPU 24 may configure the network interface 20 to connect the luminaire 10 to the network 36 using the configuration code (Block 312). The I/O interface 28 may then control an exchange of data between the luminaire 10 and the network 36 (Block 314), ending the process at Block 316.

Figure 15:
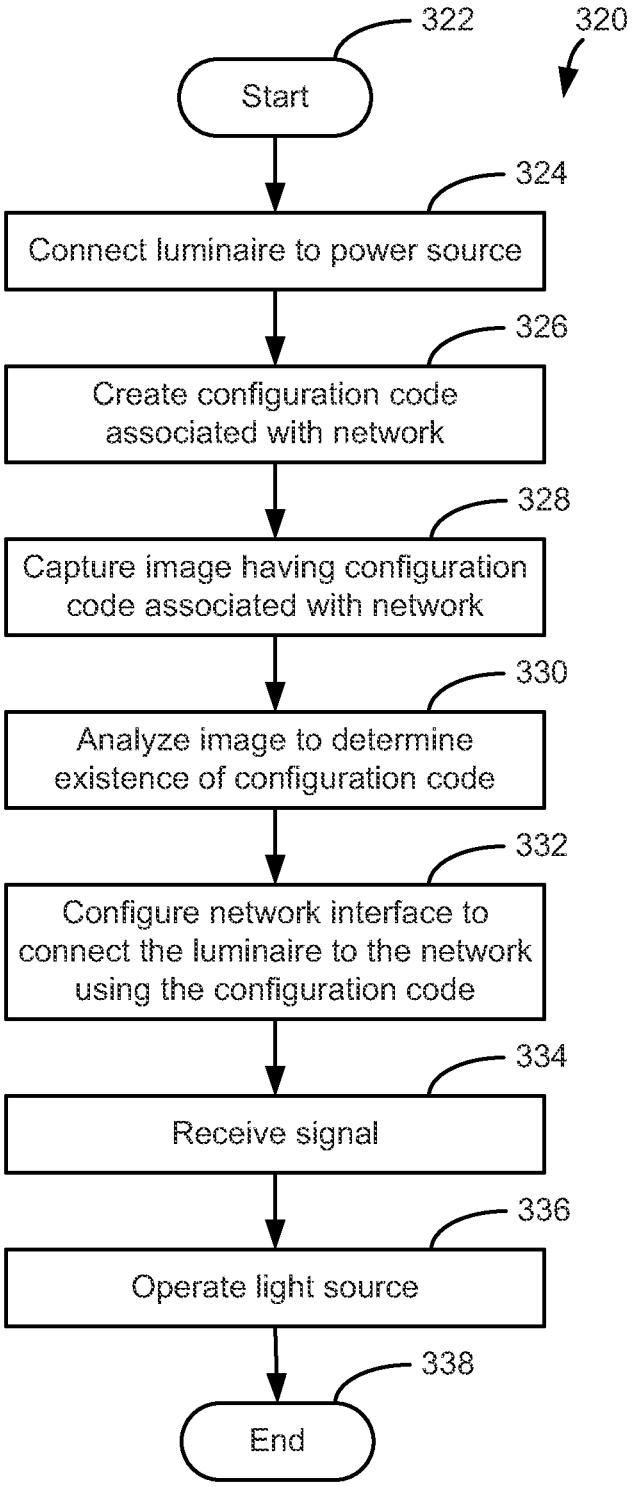

Referring now to flowchart 320 of FIG. 15, an additional method using the additional device 38 according to an embodiment of the present invention will now be discussed. Starting at Block 322, a user may connect a luminaire 10 to a power source (Block 324). Once the luminaire 10 is connected to a power source, a user may create a configuration code associated with a network 36 (Block 326), and the camera 30 may capture an image having the configuration code associated with the network 36 (Block 328). The method may then include the CPU 24 analyzing the image to determine existence of the configuration code at Block 330. From there, the CPU 24 may configure the network interface 20 to connect the luminaire 10 to the network 36 using the configuration code (Block 332). The I/O interface 28 may receive a signal transmitted over the network 36 (Block 334), causing operation of the light source 18 between an on state and an off state responsive to the signal (Block 336). The process ends at Block 338.

As discussed above, the network interface 20 may be connected to a network. Additional devices 38 may interface and communicate with the luminaire 10 of the present invention via the network connection. Examples of additional devices may include a router, modem, smartphone, a computer, a data center, a tablet, a remote, a key fob, a light switch, a motion detector, or any other device that may incorporate an interface to communicate over a network 36. Provided as a specific example, for clarity and without the intent to be limiting, the present invention contemplates that a smartphone may interface and communicate with the luminaire 10 to advantageously provide a user with the ability to view the camera output 34 being recorded by a camera 30 that may be included in the luminaire 10 of the present invention.

Provided as an additional example of the luminaire 10 of the present invention, the additional device 38 may be an additional luminaire 10. In this example, if motion is sensed by one luminaire 10, it may transmit an electronic signal to additional network connected luminaires 10 via the network interface 20. That is, a plurality of luminaires 10 may communicate with each other using the network 36. Upon receiving the aforementioned electronic signal, the components of the additional luminaire 10, i.e. the light source 18 or the recording operation of the camera 30, may be enabled or disabled via the electronic signal transmitted over the network 36. A person of skill in the art will appreciate additional devices 38 that may be connected via the network interface 20, such as light sources 18 without recording capabilities, recording devices without lighting capabilities, sirens, indicators, or dialers that may contact the police or a security department.

The network interlace 20 may provide a channel for the electronic communication of data between the luminaire 10 and an additional device 38 connected to the network 36. Provided without the intent to be limiting, examples such devices may include personal computers (PC), tablets, smartphones, personal data assistants, remote data centers, or other electronic devices capable of connecting to a network 36. The network interface 20 may connect to a network 36 via a proprietary or standard connection protocol. With respect to embodiments of the present invention that include a proprietary network connection, the network interface 20 may perform handshake operations and exchange data with additional devices 38, as may be defined within the proprietary protocol. Alternately, the network interface 20 may connect to a network 36 via a standardized protocol. Examples of standardized protocols, provided without the intent to be limiting, may include 802.3 Ethernet, 802.11 WiFi, 802.15.1 Bluetooth, 802.15.4 low rate personal area network (PAN) environments, packet switching wide area networks (WAN), cellular relay WANs, or additional standardized data transmission protocols.

The network connection may include a security protocol. More specifically, the luminaire 10 may be connected to a wireless network 36 protected by a wireless security protocol. Provided as an example, and not intended to be limiting, the luminaire 10 may connect to an 802.11 WiFi network that may include wireless security. The luminaire 10 may connect to the WiFi network via its included network interface 20. Examples of wireless security protocols that may be used to secure a WiFi network may include Wired Equivalent Privacy (WEP), WiFi Protected Access (WPA), MAC address filtering, static IP address filtering, software certificate or tokens, and/or any other protocol that may provide enhanced security for a connected network 36.

The luminaire 10 according to an embodiment of the present invention may be calibrated by performing a depth analysis using the configuration code to determine a field of depth. The luminaire 10 may determine the field of depth by capturing an image, or series of images, of the configuration code at varying distances.

Figure 16:
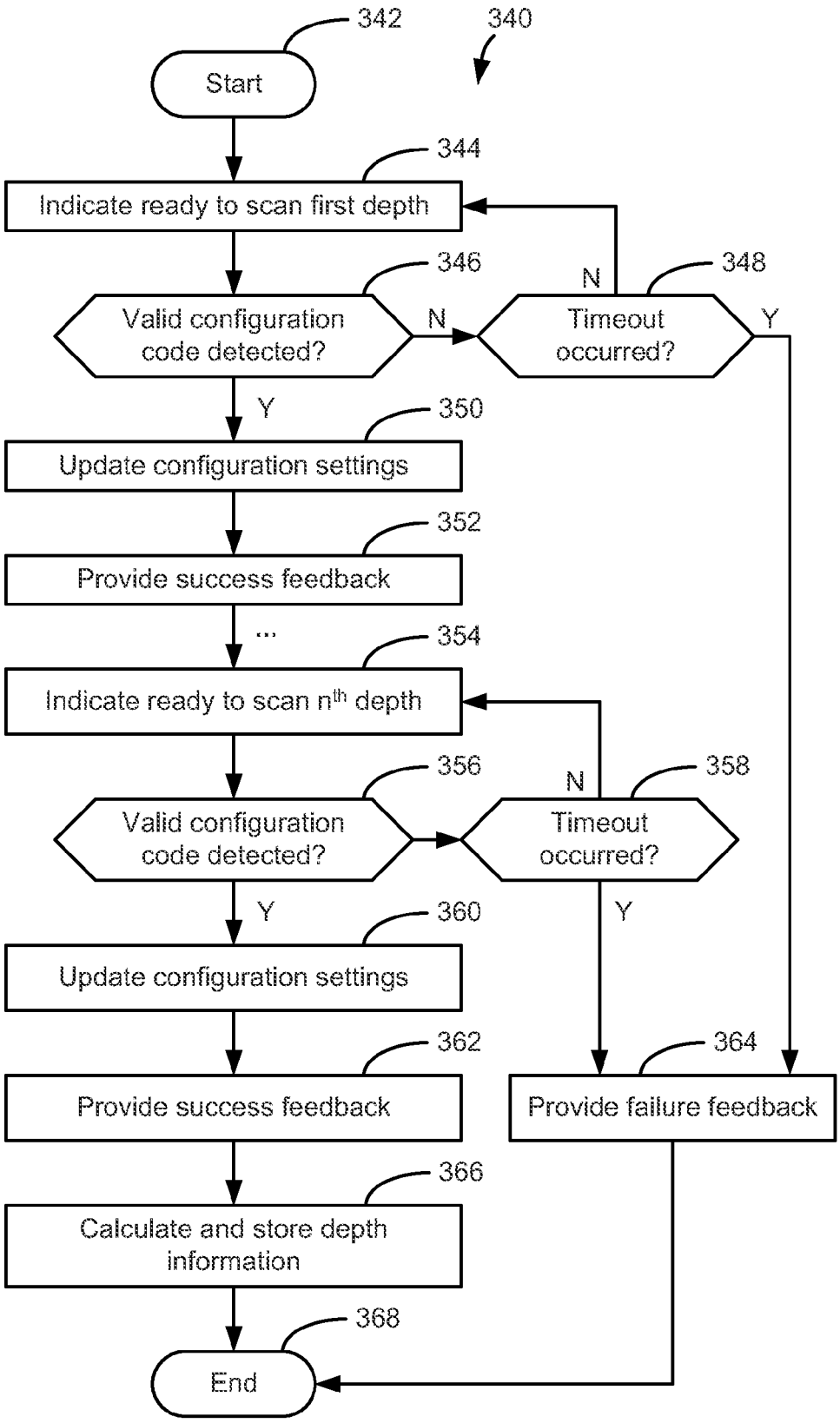
FIG. 16 is a flowchart illustrating a depth analysis operation according to an embodiment of the present invention.

Referring now to the flowchart 340 as illustrated in FIG. 16, an example of a depth analysis, as performed by the luminaire 10 of the present invention, will now be discussed. A person of skill in the art will appreciate that the following example is being provided for illustrative purposes, and thus is not intended to be limiting in any way.

Starting at Block 342, the luminaire 10 may provide an indication that it is ready to scan the first depth (Block 344). The luminaire 10 may determine the first depth by scanning and analyzing configuration codes that include depth information, comparing the size configuration code with subsequent captures of the configuration code, or performing additional depth configuration calculations that would be apparent to a person of skill in the art.

The luminaire 10 according to an embodiment of the present invention may then determine if a valid configuration code has been detected (Block 346). If no valid configuration code has been detected, the luminaire 10 may determine if a timeout has occurred (Block 348). If no timeout has occurred, the luminaire 10 may continue to perform the actions described in Block 344. If a timeout has occurred at Block 348, the luminaire 10 may provide a failure feedback to the user (Block 362). However, if a valid configuration code has been detected at Block 346, the luminaire 10 may update the configuration settings with the related depth information (Block 350). The luminaire 10 may then provide success feedback to the user, indicating the configuration settings have been successfully updated (Block 352).

After successfully determining the first depth, the luminaire 10 may next indicate that it is ready to scan a second depth. A person of skill in the art will appreciate that this operation of scanning additional depths may be performed substantially the same as the operation of scanning the first depth. Additional depths may be scanned until the luminaire 10 of the present invention may scan its final depth, which will be represented herein as the "$n^{th}$" depth. The scanning of multiple depths advantageously provides a calibration for the luminaire 10 according to the present invention.

Similar to the scanning of the first depth, the luminaire 10 may provide an indication that it is ready to scan the $n^{th}$ depth (Block 354). The luminaire 10 may determine the $n^{th}$ depth by scanning and analyzing configuration codes that include depth information, comparing the size of the configuration code with previous captures of the configuration code, or performing additional depth configuration calculations.

The luminaire 10 of the present invention may then determine if a valid configuration code has been detected (Block 356). If no valid code has been detected, the luminaire 10 may determine if a timeout has occurred (Block 358). If no timeout has occurred at Block 358, the luminaire 10 may continue to perform the actions described in Block 354. If, however, a timeout has occurred at Block 358, the luminaire 10 may provide a failure feedback to the user (Block 364), after which the operation may end at Block 368. However, if a valid configuration code has been detected, the luminaire 10 may update the configuration settings with the related depth information (Block 360). The luminaire 10 may then provide success feedback to the user, indicating the configuration settings have been successfully updated (Block 362).

Once all depths have been determined, the luminaire 10 of the present invention may calculate and store the depth information (Block 366). The depth information may be stored, for example, in the memory 26 of the controller 22. Once the depth information has been stored, the depth analysis operation may end (Block 368).

A person of skill in the art will appreciate that one or more of the above provided embodiments may be included in the operation of the luminaire 10 of the present invention. Additionally, a person of skill in the art will appreciate additional embodiments that would be included within the scope and spirit of the present invention, after having the benefit of this disclosure. Furthermore, a skilled artisan will appreciate that the operations described above, along with additional operations that would be apparent to those in the art, may be performed exclusively, incrementally, sequentially, simultaneously, or any other operative configuration.

As mentioned above, the luminaire 10 of the present invention may include a network interface 20, through which the luminaire 10 may communicate with additional devices connected to the network. Such communications may include receiving control instructions, firmware updates, or other data instructions that may affect the operation of the luminaire 10 of the present invention. These data transfer operation may occur after the luminaire 10 of the present invention has successfully paired with a network 36.

The network interface may also allow the luminaire 10 to transmit a data signal to an additional device 38 connected to the network. Such data signals may include feedback information, status updates, and video feeds of the frames captured by the camera 30 of the luminaire 10. The video feed may be transmitted to a plurality of electronic devices that may be capable of displaying a video image. In an embodiment of the present invention, the video signal transmitted to an additional device 38 may be compressed, as would be understood by a person of skill in the art.

Figure 17:
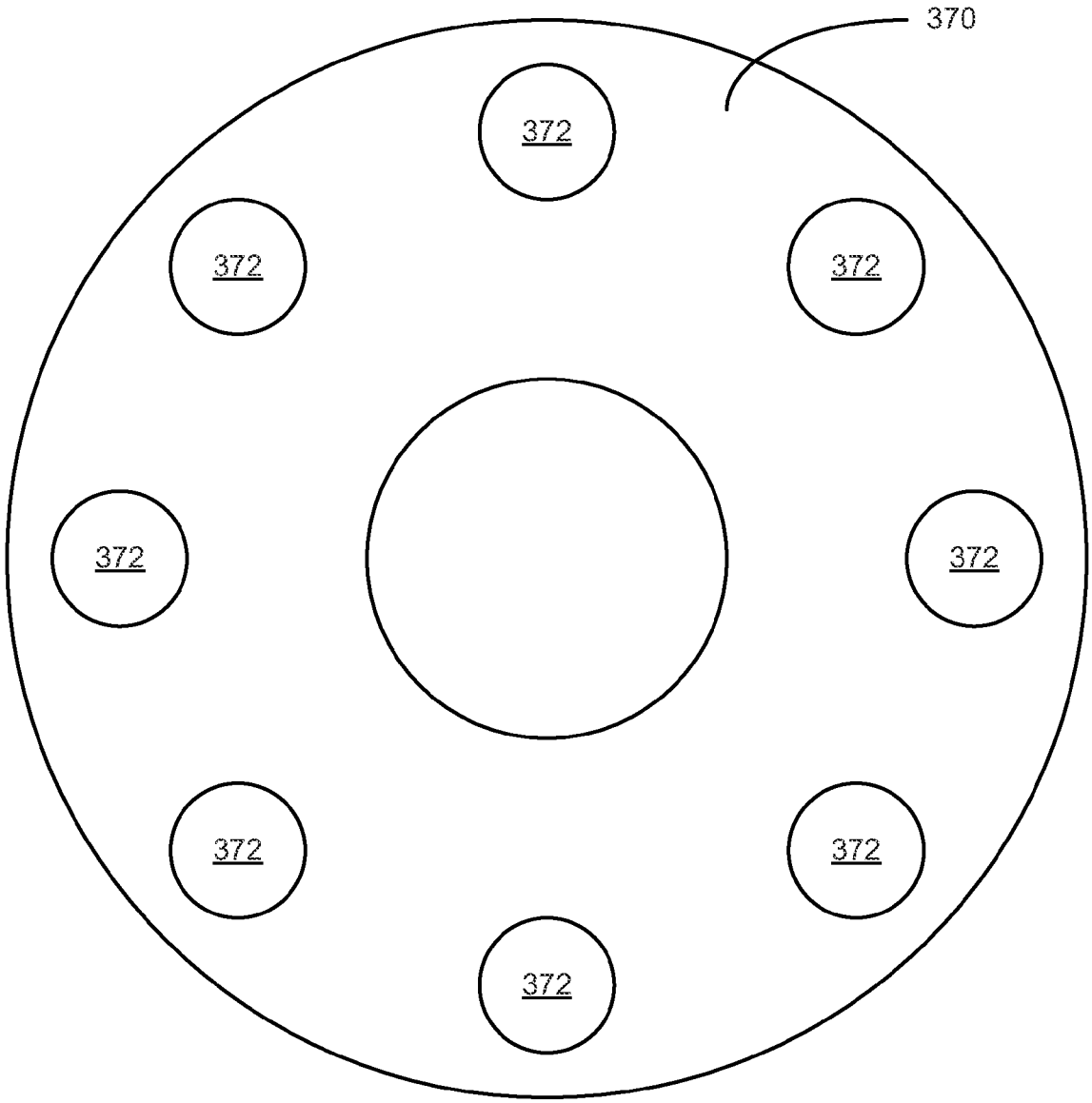
FIG. 17 is a schematic diagram of a programmable user interface according to an embodiment of the present invention.

The luminaire 10 may also include a programmable user interface according to an embodiment of the present invention. Referring now to FIG. 17, such an embodiment will now be discussed. The luminaire 10 may have a plurality of inputs 372 that may be manipulable by the user. The inputs 372 may affect settings of the luminaire 10, including, but not intended to be limited to, brightness, color, duration of a brightness or color setting, preparation for a pairing operation, or resetting previous inputs.

Continuing to refer to FIG. 17, and additionally FIG. 18, an illustrative interface 370 including eight inputs 372 will be discussed. Skilled artisans will appreciate that additional or fewer inputs 372 may be included and remain within the scope and spirit of the present invention. Also, in some of the following embodiments, a threshold duration value will be discussed. This threshold duration value is simply a variable quantity of time that may be determined by a user or a manufacturer of the luminaire 10. Additional embodiments may be apparent to a person of skill in the art after having the benefit of this disclosure.

The luminaire 10 may provide feedback. The feedback is optional, and not intended to be limiting. Feedback may be provided by emitting light from a light source 18, emitting a sound, or otherwise providing an indication that an input has been received. Furthermore, the following examples include configurations wherein two inputs 372 may be manipulated. A person of skill in the art will appreciate that as few as one input 372 and as many as a virtually limitless number of inputs 372 may be manipulated within the scope and spirit of the present invention.

The luminaire 10 may be in an off or a dimmed state on installation to allow for ready programming of the device. More specifically, in order to use the inputs 372 on the interface 370 of the luminaire 10 to program or customize various features of the luminaire 10, a user may simply engage the luminaire 10. In order for programming of the luminaire 10 to be reduced in complexity, and for example, a user may engage one of the inputs 372 initially, which may, in turn, cause the luminaire to dim to a certain intensity. For example, upon engaging one of the inputs 372, the luminaire 10 may dim to ten percent brightness. This advantageously allows for ready programming of the luminaire 10 by engaging the inputs 372 while the light being emitted by the luminaire 10 is being emitted in a dimmed state, i.e., the light does not blind the user while the user is programming the luminaire 10. Those skilled in the art will appreciate that dimming the luminaire to ten percent upon engaging one of the inputs 372 is exemplary in nature, and not meant to be limiting. Instead, the luminaire 372 may be readily dimmed to any brightness, or may even be switched to an off state for programming. Further, the skilled artisan will appreciate, after having had the benefit of reading this disclosure, that any number of inputs 372 may be readily engaged to move the luminaire 10 to an initial programming state, wherein the initial programming state may be defined as the luminaire 10 being positioned in an off state, a dimmed (or reduced power) state, or any other state other than a fully operational state.

The initial programming state of the luminaire 10 may be entered when an input 372, or any number of inputs, is engaged by the user. The luminaire 10 may remain in the initial programming state for a period of time, for example. The period of time that the luminaire 10 may remain in the initial programming state may vary. The initial programming state of the luminaire 10 may also be programmed. For example, the present invention contemplates that a first combination of inputs 372 that are engaged may allow for the initial programming state to last for a first period of time, while a second combination inputs that are engaged may allow for the initial programming state to last for a second period of time. The present invention also contemplates that a single input 372 may be engaged by the user any number of times to move the luminaire 10 between an operational state and the initial programming state. Further, the present invention contemplates that one combination of inputs 372 being engaged may cause the luminaire 10 to exit the initial programming state so that the user does not necessarily need to wait a period of time for the initial programming state to end.

Figure 18:
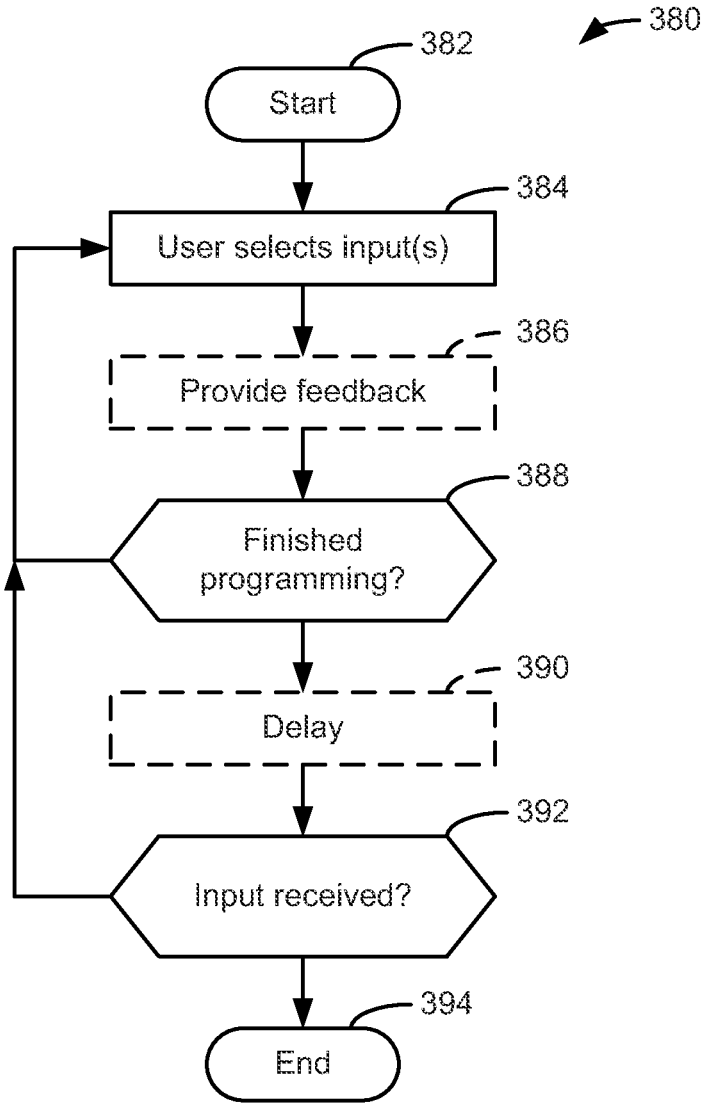
FIG. 18 is a flowchart illustrating a method of programming a luminaire according to an embodiment of the present invention.

Referring now to flowchart 380 of FIG. 18, a method of programming the luminaire 10 according to an embodiment of the present invention is now presented. Starting at Block 382, a user may select input(s) 372 to achieve a desired lighting, camera, and/or sensing pattern (Block 384). Other patterns will be readily appreciated by a skilled artisan having had the benefit of this disclosure, and are intended to be included herein. Once input(s) 372 is/are selected, the luminaire 10 may provide feedback (Block 386). As mentioned above, feedback may be provided by emitting light from a light source 18, emitting a sound, or otherwise providing an indication that an input 372 has been selected. The feedback may be an indication that the luminaire 10 has been moved to an initial programming state to readily allow a user to program the luminaire 10 as desired. As indicated above, this advantageously allows the luminaire 10 to be readily programmed while the light source 18 is emitting a dimmer light (dimmer than the fully operational state) or no light which, in turn, advantageously prevents the light emitted from the light source 18 from causing a blinding effect to the user that is programming the luminaire 10.

If the user is not finished programming the luminaire 10 at Block 388, the user may return to Block 384 and continue selecting input(s) 372. If, however, the user is finished programming, the luminaire 10 may provide a delay at Block 390, during which time the user may leave the vicinity of the luminaire 10 or continue/reset programming. If input is received at Block 392, the user returns to Block 384, where programming may continue. If no input is received at Block 392, the operation may terminate at Block 394.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A wireless pairing system comprising:

a network; and at least one luminaire comprising:

an electrical base, an enclosure, and a heat sink positioned between the electrical base and the enclosure, a light source in electrical communication with the electrical base and positioned adjacent to the heat sink, a network interface in communication with the electrical base and the light source, a controller in communication with the electrical base, the light source, and the network interface, the controller comprising a central processing unit (CPU), a memory, and an input/output (I/O) interface to control receipt and transmission of data, and a camera in communication with the controller and comprising an image sensor and a camera output, wherein at least one of the controller, the camera, the light source and the network interface are carried by the enclosure;

wherein the configuration code is creatable using a configuration code generator having a user interface;

wherein the configuration code generator is in communication with the network;

wherein the camera captures an image having a configuration code associated with the network;

wherein the CPU analyzes the image to determine existence of the configuration code; and wherein the CPU configures the network interface to connect the at least one luminaire to the network using the configuration code so that at least one of operating and monitoring a status of the at least one luminaire is controllable through the network.

2. A system according to claim 1 wherein the light source is at least one of a semiconductor lighting device, a laser, a light emitting diode (LED), and an infrared lighting device.

3. A system according to claim 1 wherein the configuration code associated with the network is at least one of a one-dimensional barcode and a two-dimensional matrix barcode.

4. A system according to claim 1 wherein the network is in communication with at least one additional device.

5. A system according to claim 4 wherein the at least one luminaire is controllable by the at least one additional device; and wherein the at least one additional device has a control interface.

6. A system according to claim 5 wherein the control interface of the at least one additional device is at least one of a computer-operable program and a mobile device application.

7. A system according to claim 4 wherein the at least one additional device is at least one of a personal computer, a mobile phone, a tablet, a smartphone, a laptop, and a server.

8. A system according to claim 4 wherein the camera output is accessible using the at least one additional device.

9. A system according to claim 4 wherein the at least one additional device and the at least one luminaire transmit and receive data using the network.

10. A system according to claim 4 wherein an exchange of data between the at least one luminaire and the at least one additional device in communication with the network is controllable using the I/O interface.

11. A system according to claim 1 wherein an exchange of data between the at least one luminaire and the network is controllable using the I/O interface.

12. A system according to claim 1 wherein a signal transmitted over the network is receivable by the I/O interface, and wherein the light source is operable between an on state and an off state responsive to the signal.

13. A luminaire comprising:

an electrical base, an enclosure, and a heat sink positioned between the electrical base and the enclosure;

a light source in electrical communication with the electrical base and positioned adjacent to the heat sink;

a network interface in communication with the electrical base and the light source;

a controller in communication with the electrical base, the light source and the network interface, the controller comprising a central processing unit (CPU), a memory, and an input/output (I/O) interface to control receipt and transmission of data; and a camera in communication with the controller and comprising an image sensor and a camera output;

wherein at least one of the controller, the camera, the light source and the network interface are carried by the enclosure;

wherein the light source is at least one of a semiconductor lighting device, a laser, a light emitting diode (LED), and an infrared lighting device, wherein the camera captures an image having a configuration code associated with a network;

wherein the CPU analyzes the image to determine existence of the configuration code;

wherein the CPU configures the network interface to connect the luminaire to the network using the configuration code so that at least one of operating and monitoring a status of the luminaire is controllable through the network;

wherein the network is in communication with at least one additional device;

wherein the luminaire is controllable by the at least one additional device; and wherein the at least one additional device has a control interface.

14. A luminaire according to claim 13 wherein the configuration code is creatable using a configuration code generator having a user interface.

15. A luminaire according to claim 14 wherein the configuration code generator is in communication with the network.

16. A luminaire according to claim 13 wherein the configuration code associated with the network is at least one of a one-dimensional barcode and a two-dimensional matrix barcode.

17. A luminaire according to claim 13 wherein the control interface of the at least one additional device is at least one of a computer-operable program and a mobile device application.

18. A luminaire according to claim 13 wherein the at least one additional device is at least one of a personal computer, a mobile phone, a tablet, a smartphone, a laptop, and a server.

19. A luminaire according to claim 13 wherein the camera output is accessible using the at least one additional device.

20. A luminaire according to claim 13 wherein the at least one additional device and the luminaire transmit and receive data using the network.

21. A luminaire according to claim 13 wherein an exchange of data between the luminaire and the at least one additional device in communication with the network is controllable using the I/O interface.

22. A luminaire according to claim 13 wherein an exchange of data between the luminaire and the network is controllable using the I/O interface.

23. A luminaire according to claim 13 wherein a signal transmitted over the network is receivable by the I/O interface, and wherein the light source is operable between an on state and an off state responsive to the signal.

24. A method of operating a wireless pairing system comprising:

connecting a luminaire to a power source, the luminaire comprising an electrical base, an enclosure, and a heat sink positioned between the electrical base and the enclosure, a light source in electrical communication with the electrical base and positioned adjacent to the heat sink, a network interface in communication with the electrical base and the light source, a controller in communication with the electrical base, the light source, and the network interface, the controller comprising a central processing unit (CPU), a memory, and an input/output (I/O) interface to control receipt and transmission of data, and a camera in communication with the controller and comprising an image sensor and a camera output;

creating a configuration code associated with a network using a configuration code generator in communication with the network having a user interface;

capturing an image having the configuration code associated with the network;

analyzing the image to determine existence of the configuration code;

configuring the network interface to connect the luminaire to the network using the configuration code; and performing at least one of operating and monitoring a status of the luminaire using the network.

25. A method according to claim 24 wherein the light source is at least one of a semiconductor lighting device, a laser, a light emitting diode (LED), and an infrared lighting device.

26. A method according to claim 24 wherein the configuration code associated with the network is at least one of a one-dimensional barcode and a two-dimensional matrix barcode.

27. A method according to claim 24 wherein the network is in communication with at least one additional device.

28. A method according to claim 27 further comprising controlling the luminaire using the at least one additional device; wherein the at least one additional device has a control interface.

29. A method according to claim 28 wherein the control interface of the at least one additional device is at least one of a computer-operable program and a mobile device application.

30. A method according to claim 27 wherein the at least one additional device is at least one of a personal computer, a mobile phone, a tablet, a smartphone, a laptop, and a server.

31. A method according to claim 27 further comprising accessing the camera output using the at least one additional device.

32. A method according to claim 27 further comprising transmitting and receiving data by the at least one additional device and the luminaire, wherein the at least one additional device and the luminaire are using the network.

33. A method according to claim 27 further comprising controlling an exchange of data between the luminaire and the at least one additional device in communication with the network using the I/O interface.

34. A method according to claim 24 further comprising controlling an exchange of data between the luminaire and the network using the I/O interface.

35. A method according to claim 24 further comprising receiving a signal transmitted over the network, wherein the signal is receivable using the I/O interface, and operating the light source between an on state and an off state responsive to the signal.

36. A method of pairing a luminaire to a network in communication with at least one additional device having a control interface, the luminaire comprising an electrical base, an enclosure, and a heat sink positioned between the electrical base and the enclosure, a light source in electrical communication with the electrical base and positioned adjacent the heat sink, a network interface in communication with the electrical base and the light source, a controller in communication with the electrical base, the light source, and the network interface, the controller comprising a central processing unit (CPU), a memory, and an input/output (I/O) interface to control receipt and transmission of data, and a camera in communication with the controller and comprising an image sensor and a camera output, the method comprising:

connecting a plurality of luminaires to a power source;

creating a configuration code associated with the network;

capturing an image having a configuration code associated with the network;

analyzing the image to determine existence of the configuration code;

configuring the network interface to connect the plurality of luminaires to the network using the configuration code;

performing at least one of operating and monitoring a status of the plurality of luminaires through the network; and controlling the plurality of luminaires using the at least one additional device.

37. A method according to claim 36 wherein the light source is at least one of a semiconductor lighting device, a laser, a light emitting diode (LED), and an infrared lighting device.

38. A method according to claim 36 wherein the step of creating the configuration code is performable using a configuration code generator having a user interface.

39. A method according to claim 38 wherein the configuration code generator is in communication with the network.

40. A method according to claim 36 wherein the configuration code associated with the network is at least one of a one-dimensional barcode and a two-dimensional matrix barcode.

41. A method according to claim 36 wherein the control interface of the at least one additional device is at least one of a computer-operable program and a mobile device application.

42. A method according to claim 36 wherein the at least one additional device is at least one of a personal computer, a mobile phone, a tablet, a smartphone, a laptop, and a server.

43. A method according to claim 36 further comprising accessing the camera output using the at least one additional device.

44. A method according to claim 36 further comprising transmitting and receiving data by the at least one additional device and the plurality of luminaires, wherein the at least one additional device and the plurality of luminaires are using the network.

45. A method according to claim 36 further comprising controlling an exchange of data between the plurality of luminaires and the at least one additional device in communication with the network using the I/O interface.

46. A method according to claim 36 further comprising controlling an exchange of data between the plurality of luminaires and the network using the I/O interface.

47. A method according to claim 36 further comprising receiving a signal transmitted over the network, wherein the signal is receivable using the I/O interface, and operating the light source between an on state and an off state responsive to the signal.

48. A method according to claim 36 wherein the plurality of luminaires communicate with each other using the network.

* * * * *